US011471379B2

(12) United States Patent
Quackenbush et al.

(10) Patent No.: US 11,471,379 B2
(45) Date of Patent: Oct. 18, 2022

(54) INFANT SUCKLING DEVICE

(71) Applicant: Momtech Inc., Matthews, NC (US)

(72) Inventors: Carr Lane Quackenbush, Monson, MA (US); Michael Maloney, Caledon East (CA)

(73) Assignee: Momtech Inc., Matthews, NC (US)

( * ) Notice: Subject to any disclaimer, the term of this patent is extended or adjusted under 35 U.S.C. 154(b) by 0 days.

(21) Appl. No.: 17/509,192

(22) Filed: Oct. 25, 2021

(65) Prior Publication Data

US 2022/0192929 A1 Jun. 23, 2022

Related U.S. Application Data

(60) Provisional application No. 63/107,403, filed on Oct. 29, 2020.

(51) Int. Cl.
*A61J 11/00* (2006.01)
*A61J 17/00* (2006.01)

(52) U.S. Cl.
CPC ..... *A61J 11/0065* (2013.01); *A61J 11/005* (2013.01); *A61J 17/001* (2015.05)

(58) Field of Classification Search
CPC .... A61J 11/0065; A61J 11/005; A61J 11/001; A61J 11/0055; A61J 17/02; A61J 17/001;
(Continued)

(56) References Cited

U.S. PATENT DOCUMENTS 6,588,613 B1 * 7/2003 Pechenik ..... A61J 11/001 215/11.1
2004/0182813 A1 9/2004 Gilmore
(Continued)

FOREIGN PATENT DOCUMENTS

CN 107616921 A 1/2018
CN 211024183 U 7/2020
(Continued)

OTHER PUBLICATIONS

International Search Report and Written Opinion dated Feb. 15, 2022 in corresponding International Application No. PCT/US2021/056949, 5 pages.

*Primary Examiner* — Diane D Yabut
(74) *Attorney, Agent, or Firm* — Lathrop GPM LLP; Wm. Tucker Griffith

(57) ABSTRACT

The human nipple functions for both nutritive and non-nutritive suckling with the only difference that in the first instance nutritive fluid is delivered. The present invention conflates these two suckling devices. A nipple device comprises a first reinforcing member provided at the exterior surface of a nipple portion, and surrounding an interior elastomeric core. A second reinforcing member, such as a mesh reinforcement, can be added to improve bite resistance without compromising stretchiness or compressibility. The nipple device is bite-resistant to guard against biting damage and stretching-to-failure by an infant; and compressible, so forces applied by an infant's tongue will be transmitted (in the case of an artificial feeding teat) through a solid nipple core to compress and shutoff central duct(s) to facilitate swallowing without gagging, or (in the case of a pacifier) to reshape the nipple portion so it conforms to the shape of the infant's oral cavity.

22 Claims, 16 Drawing Sheets

(58) Field of Classification Search
CPC ..... A61J 17/105; A61J 17/107; A61J 17/111; A61J 1/00
USPC ..... 606/236
See application file for complete search history.

(56) References Cited

U.S. PATENT DOCUMENTS

| | | | | |
|---|---|---|---|---|
| 2010/0308002 | A1 | 12/2010 | Vischer et al. | |
| 2012/0248056 | A1 * | 10/2012 | Fischer | B29C 45/1615 215/11.4 |
| 2018/0021222 | A1 | 1/2018 | Quackenbush | |
| 2018/0021998 | A1 * | 1/2018 | Quackenbush | B29B 11/14 264/279 |

FOREIGN PATENT DOCUMENTS

| | | | | |
|---|---|---|---|---|
| EP | 1297814 | A1 * | 4/2003 | A61J 11/0015 |
| JP | 2011-510765 | A | 4/2011 | |
| WO | WO-2006011573 | A1 * | 2/2006 | A61J 11/005 |

* cited by examiner

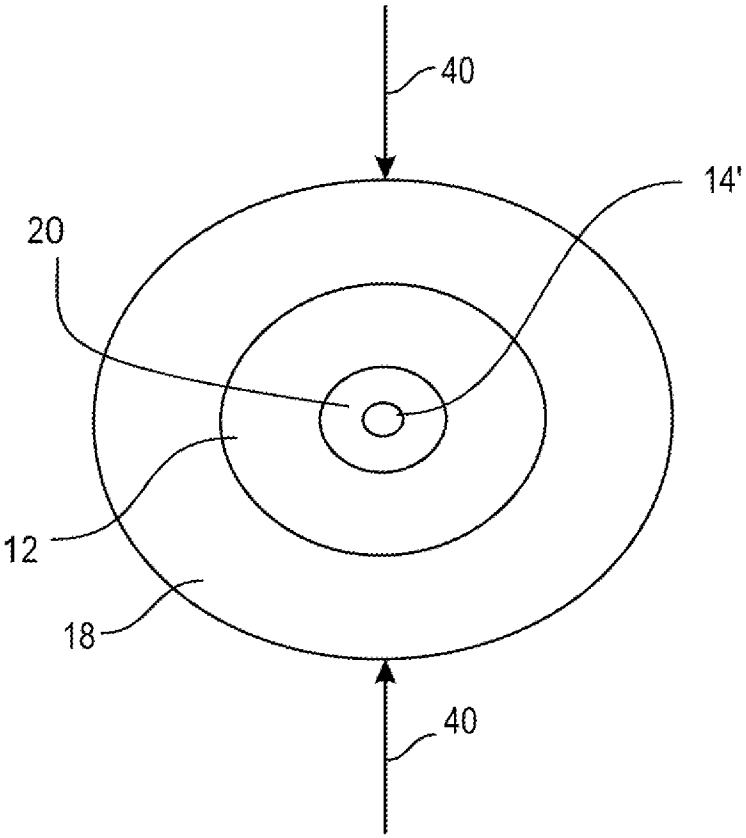
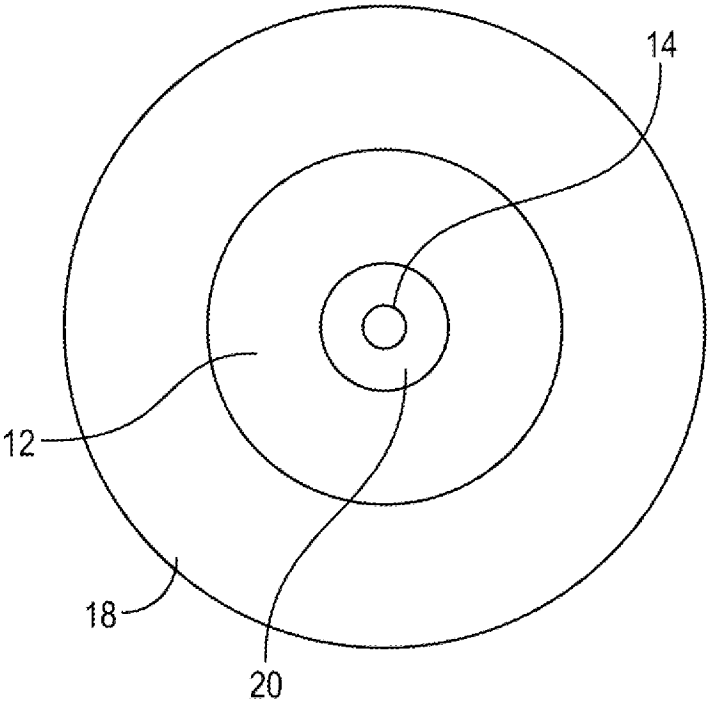
FIG. 1B
(PRIOR ART)

Elongation and compression shutoff test results for 0.5-inch diameter silicone cylinders

| Reinforcing element (20) silicone material | Tear strength (Ppi) | Reinforcing element (20) wall thickness (in) | Reinforcing element (20) cross-section area (sq in) | Nipple core (50) silicone material | Load-to-failure (lbs.) after puncture | % elongation at 15 PSI | Radial pressure (PSI) to shut off flow |
|---|---|---|---|---|---|---|---|
| A50 | 290 | 0.037 | 0.054 | A5 | >30 | 7% | 4 |
| A25 | 168 | 0.063 | 0.086 | A3 | 20 | 31% | 6 |
| A10 | 125 | 0.100 | 0.126 | A3 | >30 | 74% | 6 |
| A10 | 125 | 0.250 | 0.196 | A10 | >30 | 54% | 5 |
| A5 | 60 | 0.250 | 0.196 | A5 | >30 | 82% | 3 |

FIG. 4

Compression shutoff test results for 0.5-inch diameter silicone cylinders with reinforcing element on exterior surface or tightly surrounding duct(s)

| Reinforcing element silicone material | Reinforcing element cross-section area (sq in) | Reinforcing element wall thickness (in) | Reinforcing element location | Nipple core silicone material | Load-to-failure (lbs.) after puncture | Radial pressure (PSI) to shut off |
|---|---|---|---|---|---|---|
| A50 | 0.055 | 0.037 | exterior | A5 | >30 | 4 |
| A50 | 0.058 | 0.088 | surrounding duct | A5 | >30 | 16 |

FIG. 5

Measured elongation ratio (X = the length ratio of the elongated fiber mesh tube to the relaxed fiber mesh tube) versus applied stress for 0.5-inch cylindrical A5 silicone samples with fiber mesh tubes having a 0.375-inch inside diameter and different fiber pitches.

Measured elongation ratio (X, a measure of "stretchiness") at 15 PSI versus the ratio of the sample fiber pitch value divided by 0.71-inch, the ideal pitch for $D_r$= 0.375 and an assumed value of X (= 1.5).

| Fiber pitch (inches) | Percentage of ideal (calculateted) pitch +0.71" | +/- % of ideal (calculated) pitch | Measured elongation (X) at 15 PSI load | Elongation % at 15 PSI load |
|---|---|---|---|---|
| no fiber | N/A | N/A | 1.85 | 85% |
| 0.54 | 76% | -24% | 1.80 | 80% |
| 0.7 | 99% | -1% | 1.57 | 57% |
| 0.75 | 106% | 6% | 1.45 | 45% |
| 0.9 | 127% | 27% | 1.25 | 25% |
| 1.1 | 155% | 55% | 1.15 | 15% |

FIG. 10

INFANT SUCKLING DEVICE

CROSS-REFERENCE TO RELATED APPLICATIONS

This application claims the benefit of U.S. Provisional Application No. 63/107,403, filed Oct. 29, 2020, the entirety of which is hereby incorporated by reference.

TECHNICAL FIELD OF THE INVENTION

The present invention relates generally to devices used for infant suckling, both nutritive and non-nutritive applications, and, more particularly to artificial teats or pacifiers that are designed to mimic properties of natural teats and the action of those natural teats in an infant's mouth whether used for feeding or calming.

BACKGROUND OF THE INVENTION

Newborns and infants experience many benefits from breast-milk feeding that are well-documented in the scientific literature. Typically, the benefits of breastfeeding are attributed to the unique chemical composition of breastmilk. These benefits include providing protection against many illnesses caused by allergies, bacteria and viruses, such as stomach viruses, respiratory illness, ear infections, meningitis and the like. (See Fallot M E, Boyd J L, Oski F A, *Breast-feeding reduces incidence of hospital admissions for infection in infants; Pediatrics,* 1980, 65:1121-1124). Breast milk feeding also may protect against Sudden Infant Death Syndrome, increase intelligence decrease malocclusions and fight obesity.

There are also benefits for mothers, as twenty-four cumulative months of breast-feeding are reputed to halve the risks of breast cancer and osteoporosis.

In addition, there is growing evidence however that the mode of delivery is also important. During nursing, an infant executes a complex sequence of coordinated suction and mechanical tongue motions called the "suck-swallow-breathe" rhythm. During this sequence, the nipple portion of a natural teat functions in a very specific way. (See McClellan, H. L., Sakalidis, V. S., Hepworth, A. R., Hartmann, P. E. and Geddes, D. T., *Validation of Teat Diameter and Tongue Movement Measurements with B-Mode Ultrasound During Breastfeeding, Ultrasound in Medicine & Biology;* 2010 36 (11): 1797-1807).

The steps of the suck-swallow-breathe rhythm are outlined below:

1. Initially, the tongue compresses the nipple against the roof (hard palate) of the mouth and squeezes the internal milk ducts closed, thereby shutting off milk flow. This position is known as the "fully up" position. Swallowing of extracted milk then ensues.
2. After swallowing, the tongue begins dropping from the fully up position, unclamping the nipple ducts. This action initiates the "suck" phase where an increased suction within the infants mouth draws milk from the nipple into the infant's oral cavity through the ducts of the nipple. The infant stops the tongue down-motion when sufficient milk has been extracted.
3. Finally, the tongue starts back up until it is again at the fully-up position, compressing the nipple against the roof (hard palate) of the mouth, thereby squeezing the milk ducts closed, and shutting off unwanted milk flow that might cause gagging. At this point the infant again swallows, evacuating a substantial majority of the milk in the oral cavity.

This milk extraction rhythm is significant effort for the infant. That effort and the fact that, in breastfeeding, it occurs with very specific intensity, direction, sequencing etc., gives benefits nature designed.

The mechanical action of breastfeeding is significantly different than bottle feeding with an artificial teat. Breastfeeding is work. The vigorous muscle action strengthens jaw muscles. Those muscles pull on their attachments causing bones of the jaw, hard palate and skull to develop in form and proportion to the force exerted; this results in a beneficial reshaping of craniofacial bones and teeth. (See Kevin Boyd, *Darwinian Dentistry, J Am Orthodontic Soc.*, March/April 2012, pgs. 28-32). This is nature's design. For example, repeated nipple compression against the roof of the mouth (which in infants is soft) causes it to broaden into a low U-shape. A palate having this shape does not intrude into the sinuses and allows development of properly aligned teeth. (See Palmer, B., *The Influence of Breastfeeding on the Development of the Oral Cavity: A Commentary, J Human Lactation,* 1998: 14 (2): 93-98). Moreover, research shows that because of the effort, the infant tires and stops feeding when satiated. This self-regulation avoids over-feeding giving reduced weight gain and a lower incidence of obesity. (See Ruowei Li, et al.; *Risk of Bottle-feeding for Rapid Weight Gain During the First Year of Life, Arch Pediatr Adolesc Med.,* 2012; 166(5):431-436.)

Conventional baby bottle teats do not give these benefits; indeed, they cause numerous new problems. These undesirable effects of conventional baby bottle nipples can be permanent causing lasting damage. Conventional teats are very different than a mom's nipple in properties and in required muscle action. These differences require that the infant learn a milk extraction rhythm different than the natural rhythm. The beneficial muscle action of natural nursing is lost which can lead to malocclusions and poorly developed sinuses. (See Palmer (1998)). In addition, conventional baby bottle teats are less work for the infant because they have open orifices giving easy and abundant flow. Studies find the infant tends to empty the bottle regardless of liquid volume and regardless whether it contains breast milk or formula. Conventional baby bottle teats are linked with lack of self-regulation, over-feeding and excessive weight gain leading to childhood obesity. (See Peter T. Katzmarzyk et al., *An Evolving Scientific Basis for the Prevention and Treatment of Pediatric Obesity, Int'l J. Obesity* (London) July 2014, 38 (7), pp. 887-905).

Clearly there is an important unmet need and significant commercial value for both nutritive and non-nutritive suckling devices having properties more like the human teat and supporting muscle action more like that in natural nursing and suckling.

The human nipple functions for both nutritive and non-nutritive suckling. In alternating between these two functions, the nipple does not change in properties or action. For this reason, the present submission conflates two infant suckling devices that each replicate properties and muscle action of the human nipple with the only difference that, like the human nipple, one delivers nutritive fluid whereas the other does not.

Natural non-nutritive suckling (for calming at the breast). Non-nutritive suckling (NNS) is a natural continuation of natural nutritive suckling wherein the infant suckles at the breast while not extracting breast milk. If the breast is not available, infants will often suck on thumbs or fingers or on an artificial teat commonly called a pacifier. Research links non-nutritive suckling on things other than the natural nipple to numerous negative outcomes: decreased breastfeeding duration, increased malocclusions, and abnormal craniofacial developments. (See, e.g., O. Sabuncuoglu, *Understanding the relationships between breastfeeding, malocclusion, ADHD, sleep-disordered breathing, and traumatic dental injuries, Medical Hypotheses*, March 2013, Volume 80, Issue 3, pp 315-320). Other reports show high stiffness pacifiers tend to be rejected by infants and they can impact feeding outcomes. (See Zimmerman, E., Steven M. Barlow, *Pacifier stiffness alters the dynamics of the suck central pattern generator, J. Neonat. Nurs.,* 2008, 2007.12.013).

The disadvantages of conventional baby bottle teats, as well as pacifiers, for both nutritive and non-nutritive suckling stem from their design which is imposed by their material of construction.

The design challenge for artificial teats and pacifiers is that all infants eventually get teeth, so nipples and pacifiers must be bite-resistant and safe against choking hazard. Conventional feeding nipples and pacifiers all use a high tear strength material, generally silicone having a Shore A hardness between 50 and 70, which has good bite-resistance. Unfortunately, such materials are hard, nearly as hard as a car tire. Nipples or pacifiers made from such high durometer materials stretch less than 1/10 that of a natural nipple. To make the nipple or pacifier somewhat flexible, designers make them hollow. Conventional baby bottle nipples and pacifiers are nothing like a natural nipple, not in properties, not in action.

Additionally, conventional baby bottle feeding nipples are hollow, not solid, so they cannot shut off fluid flow, as does a natural nipple, when compressed by the infant's tongue. Likewise, conventional pacifiers are all hollow and, depending on design, either collapse too easily or hardly at all. Not being solid like the human nipple, such conventional pacifiers generally crumple when compressed. They cannot reshape their volume to conform to the contours of the infant's oral cavity, leading to the negative outcomes described above.

Ideally, an artificial feeding teat and a pacifier would each mimic properties of the human nipple and support muscle action of nutritive and/or non-nutritive suckling. They should have the following characteristics:

- Strong and sufficiently bite-resistant to guard against biting damage and stretching-to-failure by an infant and thereby to avoid broken pieces and the introduction of choking hazards.
- Solid and compressible, so forces applied to the outside surface of the nipple by the infant's tongue will be transmitted (in the case of an artificial feeding teat) through the solid nipple core to compress and shut off the central duct(s) to facilitate swallowing without gagging, or (in the case of a pacifier device) to reshape the nipple portion so it conforms to the shape of the infant's oral cavity.
- Soft, to simulate a human nipple.
- Stretchy, so the infant can elongate it for proper positioning at the back of the mouth.

FIGS. 1A and 1B illustrate a conventional artificial feeding nipple known in the art. More particularly, this prior art design applies the teachings of U.S. Pat. No. 8,448,796 to Silver, which is a highly relevant piece of prior art claiming a nipple with radial compression shutoff and axial reinforcement.

In general, Silver claims a solid nipple capable of shutting off fluid flow with radial compression and having a "cylindrical reinforcing member embedded in said solid nipple part in a close but spaced configuration relative to said one or more ducts and said reinforcing member having a greater resistance to a tearing force than said solid nipple part." However, it has been determined that locating a reinforcing member in such a manner does not allow the nipple to adequately mimic an infant's natural suckling action. As will be shown, the reinforcing member located "close . . . to . . . ducts," such as illustrated in FIGS. 1A and 1B, will unduly reduce radial compressibility needed for compression shutoff.

Referring to FIG. 1A, and with reference to FIG. 18 in U.S. Pat. No. 8,448,796 to Silver, the prior art design comprises a nipple 10 with a reinforcing element 12, pictured as tubular, located close to the central duct(s) 14. Silver discloses other, non-tubular reinforcing elements, all located close to the central duct(s). These other geometries are expected to show similarly high resistance to compression shutoff as the tested tubular samples. The base portion 16 and the reinforcing element 12 are tear-resistant, high-durometer material, for example Shore A50-A70 silicone. The exterior nipple portion 18 and, when present, the innermost material 20 is soft, low tear-resistant, low-durometer material, for example Shore A5 silicone.

In FIG. 1A, the load path starts with the load 22, ninety Newtons (about 20 pounds) for regulatory test EN 14350-1, 6.3 (discussed in more detail below) pulling down on the bottle 24 with which the nipple 10 is used. This force is transmitted through threads 26 connecting the bottle 24 to an attachment collar 28 which clamps (with a clamping force shown at 30) a nipple attachment flange 32 of the nipple 10 to the top of the bottle 24. The force is then transmitted through this clamp zone to the nipple flange 32 up the dome of the base portion 16 to a scarf joint 34 where the high durometer base portion 16 is bonded to the low durometer exterior nipple portion 18. The scarf joint 34 is in shear as the downward pull of the domed base portion 16 resists the upward pull of the exterior nipple portion 18. The force travels through the exterior nipple portion 18 through bond line 36 (where the exterior nipple portion 18 is bonded to the reinforcing element 12) then into and up the reinforcing element 12, back through the proximal end of the bond line 36 out through the proximal end of the exterior nipple portion 18, then finally out to the upper surface of the nipple portion where a grip exerts the upward force 38. Under load, the exterior nipple portion 18 will carry some load, but because of its low elastic modulus its load carrying will be much less than the higher elastic modulus reinforcing element 12.

Referring to FIG. 1B, radial compressive forces 40 exerted on the exterior surface are transmitted to the soft exterior nipple portion 18 to the hard tubular reinforcing element 12 to the soft interior nipple portion 20, if present, and finally to the central axial duct(s) (14 changing to 14' when compressed). A major disadvantage of Silver's design is the stated requirement that the hard tubular reinforcing element 12 is located "close . . . to . . . ducts." This results in a tube which is thick-walled, as needed to carry the axial load, and "close . . . to . . . ducts" so it resists compression of the duct(s) it tightly surrounds. And so, with Silver's design, a higher compressive force is required to shut off the duct.

The present invention addresses the limitations on the conventional feeding teat design, such as in Silver, to optimize the suckling action and compression shut off during use while maintaining sufficient axial strength.

As noted above, conventional pacifiers are generally constructed of high tear strength material, generally silicone having a Shore A hardness between 50 and 70 which has good bite-resistance. Unfortunately, such materials are hard, and stretch little or not at all. The harder the more they resist reshaping to the geometry of the infant's oral cavity. Research links non-nutritive suckling on things other than the natural nipple, and especially on harder, non-compliant pacifying devices to numerous negative outcomes: decreased breastfeeding duration, altered feeding cycles, increased malocclusions, and abnormal craniofacial developments. (see Sabuncuoglu (2013); Zimmerman & Barlow (2008)).

FIG. 2 shows the cross section of a typical commercial pacifier 100, which comprises a tubular nipple portion 102, a dome-shaped base portion 104 and a radially extending base flange 106. This pacifier 100 is constructed completely of silicone with a hardness of about Shore A50 to A70. To make the pacifier 100 somewhat flexible, the nipple portion 102 and dome-shaped base portion 104 are both hollow. In other designs, the dome-shaped base portion 104 which attaches to the nipple portion 102, or the base flange 106 may have a handle or guard constructed of rigid plastic. As pictured in FIG. 2, the nipple portion 102 has a nominally cylindrical shape. In other commercial pacifier designs, the nipple portion 102 can have an orthodontic shape.

Clearly, there is an important unmet need for a non-nutritive suckling device having properties more like the human teat and supporting muscle action more like that in natural non-nutritive suckling. The present submission addresses that unmet need.

It is relatively easy to design and produce an artificial nipple or pacifier which is stretchy, soft, solid and compressible. It is far more difficult to design a nipple which has those properties and which is strong and safe against biting damage and stretching-to-failure. Such a soft, compressible nipple or pacifier, one that duplicates properties of a human nipple and has the potential to replicate the natural suckling action of an infant, yet is safe, would have considerable commercial value. The fact that no such nipple or pacifier has been commercialized clearly indicates that those skilled in the art have not solved this design problem. The present submission sets out to correct this deficiency, as discussed below.

In general, therefore, there is a need for a bite-safe artificial teat that is stretchy, soft, solid and compressible, but which also is safe against biting damage and stretching-to-failure. The present invention sets out to address the issues associated with conventional artificial nipple designs, correct the deficiencies in the prior art, and provide a means to circumvent the associated drawbacks of such prior art designs.

SUMMARY OF THE INVENTION

The present invention provides an infant suckling device, such as an artificial bite-safe nipple or teat, designed for use with a baby bottle for nutritive feeding, and a pacifier device, for use as a non-nutritive pacifier, each with sufficient axial strength to pass testing designed to simulate severe use and abuse, the biting damage and excessive stretching, by an infant, yet retaining sufficient "stretchiness" and radial compliance to be capable of compression shutoff by an infant and/or or reshaping to conform to the shape of the infant's oral cavity during suckling action.

In a first aspect of the present invention, a device for nutritive infant suckling which is bite-resistant yet retains deformability both longitudinally and transversely comprises an axially strong artificial feeding teat having compression shutoff. In preferred embodiments, the suckling device comprises a solid nipple portion having a proximal end, a distal end and an exterior generally cylindrical surface, although other shapes are possible. At least a portion of the nipple portion comprises a first reinforcing element extending longitudinally between the distal end of the nipple portion and the proximal end of the nipple portion and extending axially inward from the exterior cylindrical surface of the nipple portion. The nipple portion further comprising an interior core portion extending at least part-way between the proximal and distal ends of the nipple portion and being axially surrounded by the first reinforcing element and defining at least one duct extending generally longitudinally from the distal end of said nipple portion to the proximal end of said nipple portion. The device also comprises a base portion attached at the distal end of the nipple portion and having an open interior volume contiguous with the distal end of the at least one duct.

In accordance with embodiments of the present invention, the first reinforcing element is made of an elastomeric material having a hardness of about Shore A5 to about Shore A70 and further having properties and a cross-sectional area sufficient to impart bite-resistance and axial strength for expected biting damage and excessive elongation by an infant user without compromising longitudinal and transverse deformability. Additionally, the interior core portion comprises an elastomer having a hardness of about Shore A1 to about Shore A20. The resulting composite nipple portion has sufficient radial deformability to allow a compressive force applied transversely by an infant's tongue of 8 PSI or less to be transmitted through the nipple portion causing a compressive collapse of the at least one duct and thereby stopping fluid flow.

In another aspect of the present invention, a device for nutritive and non-nutritive infant suckling which is bite-resistant yet retains deformability both longitudinally and transversely comprises a pacifier device capable of changing shape under the action of infant suckling such that the device conforms to the shape of the infant's oral cavity during suckling action. In preferred embodiments, the suckling device comprises a solid nipple portion having a proximal end, a distal end and an exterior generally cylindrical surface. At least a portion of the nipple portion comprises a first reinforcing element extending longitudinally between the distal end of the nipple portion and the proximal end of the nipple portion and extending axially inward from the exterior cylindrical surface of the nipple portion. The nipple portion further comprising an interior core portion extending at least part-way between the proximal and distal ends of the nipple portion and being axially surrounded by the first reinforcing element. The device also comprises a base portion attached at the distal end of the nipple portion.

In another aspect of the present invention, a second reinforcing element is disposed within the nipple portion, preferably longitudinally extending between the distal end of the nipple portion and the proximal end of the nipple portion and being located radially within at least a portion of the first reinforcing element. For example, the second reinforcing element can be sandwiched between the first reinforcing element and the inner core portion. In alternate embodiments, the second reinforcing element can be embedded within the first reinforcing element, such as, in the form of a fiber mesh tube consisting of fibers that extend between the proximal end of the nipple portion and the distal end of the nipple portion to provide bite-resistance to the nipple portion without exerting tension or compression to the nipple portion, or as a moldable nylon or silicone material molded into the nipple portion in one of a solid tubular shape, or a mesh pattern.

In aspects of the present invention, the reinforcing elements have a tear strength greater than or equal to the interior core portion of the nipple portion.

In another aspect of the present invention, a bite-safe artificial teat, such as a nipple, is used in an improved feeding system. Such a system comprises a collection container, generally a bottle, having a tubular top opening with a smooth top lip; a collar which threads onto the collection container, having a top portion with a surface facing the collection container nominally plane parallel to the axis of the collar, and a center hole in the top portion; and an artificial teat having a nipple portion of unspecified design, a base portion and, at the extreme distal end of said artificial teat, an attachment portion having a flat-ended cylindrical shape with flat distal and proximal surfaces and having a hole in the middle. In use, all but the washer-shaped proximal end of the teat base portion protrudes through the center hole of the collar, wherein, in operation, the nipple portion is pulled through the center hole in the collar and the collar screwed onto the collection container. The collection container, the collar and the artificial test are configured so that, as the collar is tightened, the attachment portion of the teat base is compressed between the distal undersurface of the collar and the top rim of the collection container sealing the teat to the bottle. A V-shaped protrusion is further provided on the proximal undersurface of the collar positioned at a radial position centered on the rim of the bottle. A corresponding V-shaped groove is provided on the distal top surface of the attachment portion of the artificial teat shaped and positioned so the V-shaped protrusion of the collar fits into it.

As noted, the human nipple functions for both nutritive and non-nutritive suckling, and, in alternating between these two functions, the nipple does not change in properties or action. In this regard, the present invention has two major focuses: (i) an artificial teat or feeding nipple designed for nutritive suckling; and (ii) a pacifier device designed for non-nutritive suckling. In accordance with the present invention, both devices have high strength to resist biting damage and elongation-to-failure and a soft core to, respectively, provide for compression shutoff and conformance to the shape of the infant's oral cavity. Additionally, each replicates properties and muscle action of the human nipple with the only difference that, like the human nipple, one delivers nutritive fluid whereas the other does not.

These and other features of the present invention are described with reference to the drawings of preferred embodiments of a bite-safe artificial nipple or teat with compression shut-off. The illustrated embodiments of features of the present invention are intended to illustrate, but not limit the invention.

BRIEF DESCRIPTION OF THE DRAWINGS

FIG. 1B illustrates compression shut-off for the prior art feeding nipple of FIG. 1A.

FIG. 4 is a Table providing elongation and compression shutoff test results for 0.5-inch diameter silicone cylinders.

FIG. 5 is a Table providing compression shutoff test results comparing 0.5-inch diameter silicone cylinders with a reinforcing element on exterior surface, in accordance with the present invention as represented in FIG. 3A, or tightly surrounding duct(s), in accordance with the prior art, as represented in FIG. 2.

FIG. 10 is a Table showing data plotted in FIG. 9.

DETAILED DESCRIPTION OF EMBODIMENTS OF THE INVENTION

The following descriptions of the figures will convey details of construction of nutritive and non-nutritive infant suckling devices in accordance with the present invention.

As used herein, the terms "proximal" and "distal" are used in their medical sense and directionally with respect to the user. Thus, the "proximal end" of a feeding nipple is the portion of the nipple closest to the infant, while the "distal end" of the feeding nipple is the portion of the nipple farthest from the infant.

Figure 3A:
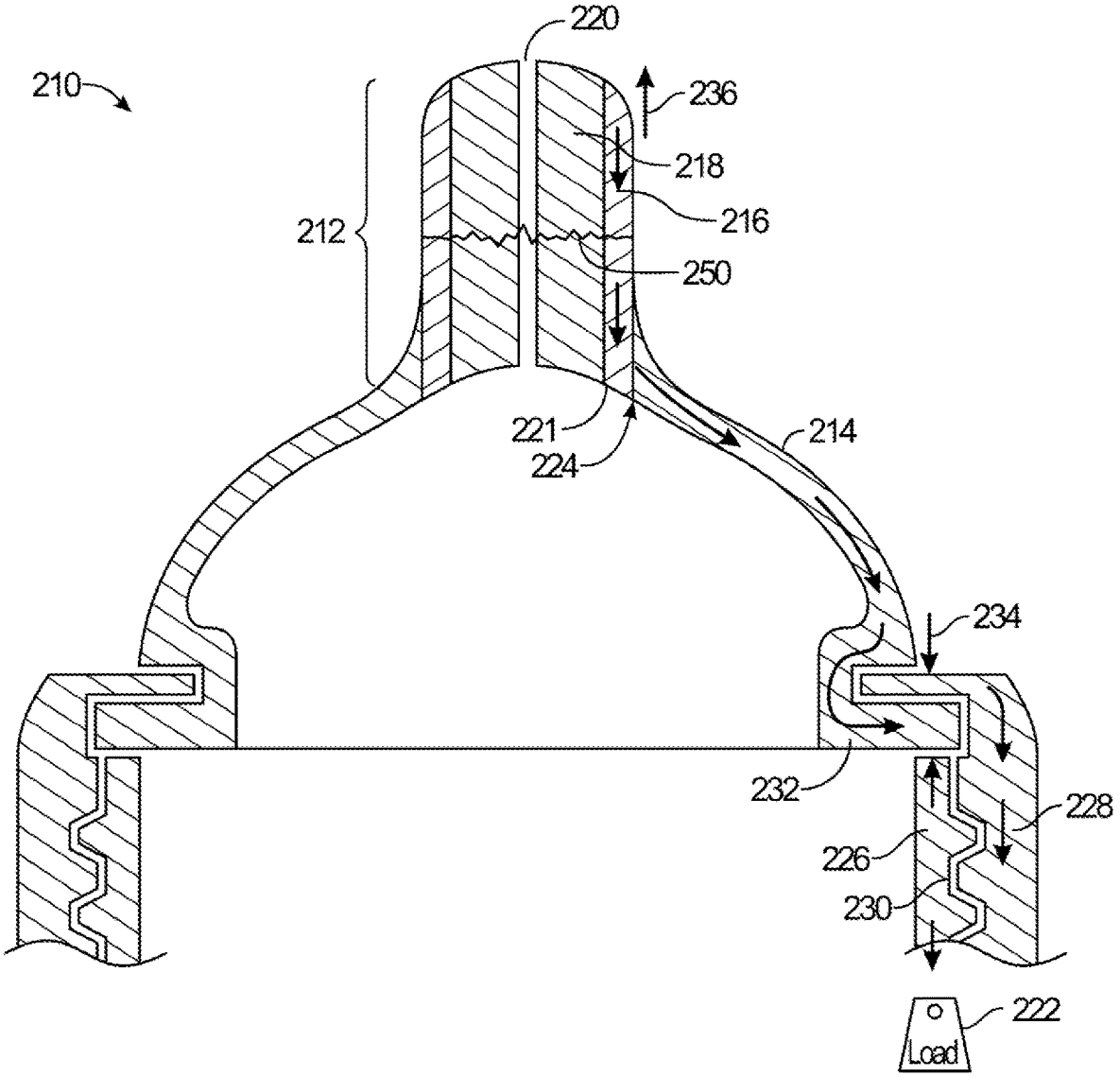
FIG. 3A illustrates a cross-sectional view of a first embodiment of a nutritive infant suckling device in accordance with the present invention.
Figure 6:
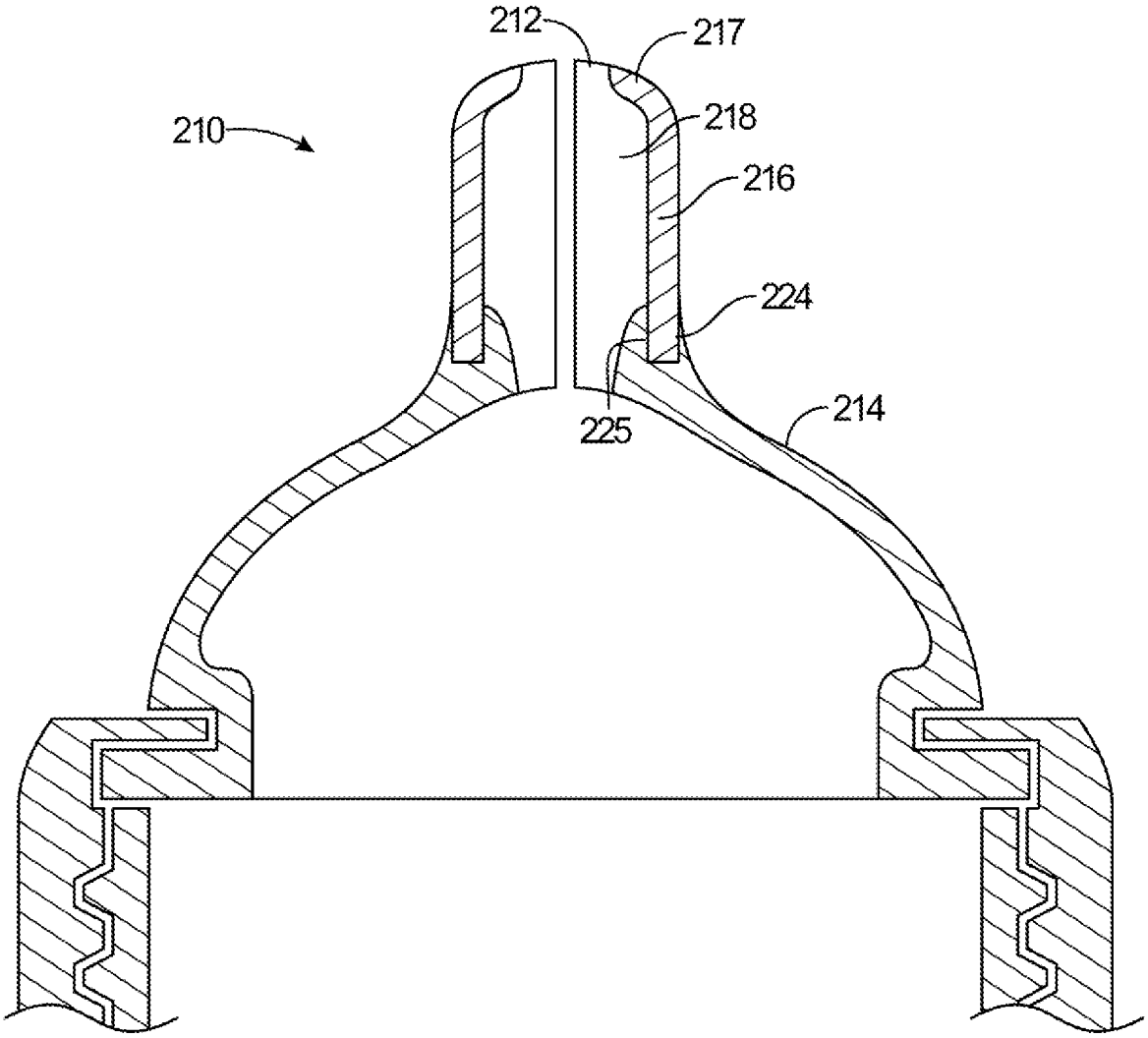
FIG. 6 illustrates a cross-sectional view of an alternative embodiment a nutritive infant suckling device in accordance with the present invention.

According to embodiments of the present invention, FIG. 3A shows a nutritive infant suckling device, such as a feeding teat or nipple generally designated as reference numeral 210 comprising a nipple portion 212 and a base portion 214. As illustrated, the nipple portion 212 includes a first reinforcing element 216 and an interior core portion 218. The first reinforcing element 216, assumed to be tubular, is positioned close to, or at the exterior surface of, the nipple portion 212. In general, the first reinforcing element 216 extends longitudinally between the distal end of the nipple portion 212 and the proximal end of the nipple portion 212 and further extends axially inward from the exterior cylindrical surface of the nipple portion 212. As illustrated in the embodiment of FIG. 6, the first reinforcing element 216 can also extend to and around the tip 217 of the nipple portion 212.

The first reinforcing element 216 preferably has a hardness of about Shore A5 to about Shore A70 and having properties and a cross-sectional area sufficient to impart bite-resistance and axial strength for expected biting damage and excessive elongation by an infant user without compromising longitudinal and transverse deformability.

Still referring to FIG. 3A, the interior core portion 218 extends at least part-way between the proximal and distal ends of the nipple portion 212 and is axially surrounded by the first reinforcing element 216. As illustrated, the interior core portion 218 also defines at least one duct 220 that extends generally longitudinally from the distal end of the nipple portion 212 to the proximal end of the nipple portion 212. The interior core portion 218 preferably is made of a soft, low tear-resistant, low-durometer material. More preferably, the interior core portion 218 comprises an elastomer, such as silicone, having a hardness of about Shore A1 to about Shore A20, and even more preferably about Shore A5.

The resulting composite nipple portion 212 in accordance with the present invention has sufficient radial deformability to allow a compressive force applied transversely by an infant's tongue of 8 PSI or less to be transmitted through the nipple portion 212 causing a compressive collapse of the at least one duct 220 and thereby stopping fluid flow.

As noted, the nipple 210 includes a base portion 214, generally resembling a dome, that is attached at the distal end of the nipple portion 212 and includes an open interior volume contiguous with the distal end of the at least one duct 220. The base portion 214 is preferably made from a tear-resistant, high-durometer material, for example Shore A50 to A70 silicone, such as materials typically used to construct conventional nipples. The first reinforcing element 216 preferably has a tear resistance and durometer the same as the base portion 214 (e.g., Shore A30 to Shore A70), or alternately, the same as the interior core portion 218 (e.g., Shore A5 to Shore A20), or at least intermediate between that of the base portion 214 and the softer interior core portion 218. The nipple portion 212 is attached to the base portion 214 such that an axial load 222 applied from the base portion 214 to the distal end of the nipple portion 212 is transferred to the first reinforcing element 216 through a scarf joint 224 disposed between the dome of the base portion 214 and the outside distal end surfaces of the reinforcing element 212.

In use, the nipple 210 is attached to a collection container, such as a bottle 226, using an attachment collar 228. The connection between the bottle 226 and collar 228 is usually through complementary threads 230, which pinch an annular attachment flange 232 formed in the base portion 214 and including a top surface and an opposing bottom surface and defining a central opening. More particularly, the attachment collar 228 has an annular end defining a central opening and a first surface, where the nipple 210 is positioned when the attachment collar 228 is connected to the bottle 226 such that the annular attachment flange portion 232 of the nipple 210 is positioned between first surface of the attachment collar 228 and a smooth top lip of the bottle 226 so that the distal end of the nipple 210 projects through the central opening of the annular end of the attachment collar 228, as illustrated in FIG. 3A.

In embodiments of the nipple 210 where the first reinforcing element 216 and the nipple interior core portion 218 are constructed from the same material having the same tear-resistance and durometer, the first reinforcing element 216 and the interior core portion 218 will essentially be separate in name only. In this case they will be the same single material with no geometric delineation between them.

Nipple biting damage and stretching to failure simulation tests—In order to evaluate nipple improvements of the present invention, specific tests are needed to quantify bite-resistance, elongation-to-failure, stretchiness, softness, and compression shutoff. These tests, some purpose-devised, others being current regulatory standards, are intended to simulate infant use and abuse conditions, as well as functionality. Use of specific test conditions is to allow quantification of advantages of the present invention and to allow comparison of the present invention with prior art devices, not to advocate any specific test.

Nipple "use and abuse" mechanical tests—The US nipple bite-resistance test defined in 16 C.F.R. § 1500.51 is relatively easy to pass and will not be considered further in connection with the present invention. By comparison, EN 14350-1, 6.3 is a European and Canadian regulatory test that is more stringent. This test specifies that first, the nipple portion of an artificial teat is punctured through the nipple portion of its diameter with a chisel-pointed 3 mm diameter punch driven by a load of 200 N (about 45 pounds). This puncture (represented as reference numeral 250 in FIG. 3A—but which does not form a part of the present invention) simulates infant biting damage. Second, the (punctured) "feeding teat and drinking accessories" (taken to mean the nipple mounted onto to a bottle) is subjected to 90 N (about 20 pounds) load applied between the bottle and the nipple tip. To pass the test, the nipple must not rupture or pull out from its attachment to the bottle. This simulates additional biting damage and excessive stretching by the infant. In evaluating the present invention, EN 14350-1, 6.3 will be used for evaluation purposes, with the exception that nipples were loaded to 120 N (30 pounds), not just proof-tested to the test-standard of 90 N (20 pounds).

EN 14350-1, 6.3 is a very demanding test. In present embodiments, separate design tactics will be described to address (a) nipple rupture and (b) nipple pull out.

Artificial nipple rupture—Typically, a stretchy, soft, solid and compressible artificial nipple has a base section which is attached to the bottle with a collar. Generally, this base section is constructed of a strong, high-durometer material having a sufficiently high tear strength, for example Shore A50-A70 silicone rubber, and because this base portion is not punctured it virtually never fails during EN 14350-1, 6.3 testing. If rupture occurs, it is invariably the nipple portion that fails. The load path from the container, through the base, into the nipple portion, then to each separate load-bearing element within the nipple portion, and finally to the nipple tip is shown with arrows in FIG. 3A.

In FIG. 3A, the load path starts with a load 222, ninety Newtons (about 20 pounds) for EN 14350-1, 6.3 pulling down on the bottle 226, this force is transmitted through the threads 230 to the flat underside of the attachment collar 228 which clamps (via a clamping force shown at 234) the flat nipple base flange 232 to the top rim of the bottle 226. The force is then transmitted through this clamp zone to the nipple base flange 232 up the dome of the base portion 214 to the scarf joint 224 where the high durometer base portion 214 is bonded to the first reinforcing element 216. The scarf joint 224 is in shear as the downward pull of the dome of the base portion 214 resists the upward pull of the first reinforcing element 216. The force travels up the first reinforcing element 216 out to the upper surface of the nipple portion 212 where the test grip exerts an upward force 236. Bonded to the inside diameter of the first reinforcing element 216 is the interior core portion 218 of the nipple portion 212, preferably comprising a soft, low tear-resistant, low-durometer material, for example Shore A5 silicone. Transversely across the middle of the nipple portion at 250, the puncture required for the EN 14350-1, 6.3 test is illustrated cutting across the soft interior core portion 218 and the first reinforcing element 216, though, as previously noted, this line is provided for illustration purposes and does not comprise any portion of the nipple device in accordance with the present invention.

In general, nipple rupture occurs at the weakest link in this load-bearing chain. Because nipples are commonly composed of multiple components, each having specific geometry and location within the nipple all bonded together and to the base portion, the tensile, shear or other loads that develop as the nipple portion is stretched under an applied load will depend on the properties of each component—e.g., elastic modulus, tear strength, tensile strength, shear strength, elongation to failure, etc., and the interplay of those properties between each element of the nipple. For example, in the context of the nipple portion 212 of the present invention, the closer the elastic modulus of the first reinforcing element 216 and the nipple interior core portion 218, the more load the nipple interior core portion 218 will carry.

Axial loading test results—As shown in the table of FIG. 4, for 0.5-inch diameter cylindrical silicone samples having nominally the same soft nipple interior core materials (e.g., Shore A5 or Shore A3) and having greater than 20 pounds load-to-failure, the load-bearing cross-section of the first reinforcing element 216 must increase when it is constructed of lower tear strength materials (representative of what is needed to pass biting damage and stretching-to-failure simulations). A cross-sectional area of 0.054 sq. in. is required for Shore A50, but greater area—namely, 0.086 sq. in.—is required for Shore A25, and still greater area—namely, 0.126 sq. in.—is required for Shore A10. It is noteworthy that even though each has similar load bearing capability—i.e., greater than 20-pound load-to-failure capability—elongation under 15 PSI load increases strongly with decreased durometer of the reinforcing element: 7% for Shore A50; 31% for Shore A25; and 74% for Shore A10. Samples with nipple portions constructed only of Shore A10 elongated 54% at 15 PSI. Samples with nipples portions constructed only of Shore A5 elongated 82% at 15 PSI.

Axial loading test conclusions are that:

- The lower the reinforcing material's tear strength, the proportionately larger the cross-sectional area of that material needed to carry a specific applied axial load. For example, with a 0.5-inch diameter sample with a Shore A5 core, the tube wall thickness of the reinforcing element required to carry 20 lbs. is 0.037-inch for Shore A50; 0.063-inch for Shore A25; 0.100-inch for Shore A10; and for samples composed only if Shore A10 or Shore A5, the reinforcing element must occupy the entire cross section of the tube wall.
- Samples fail at the weakest link in the load path. Some samples failed by tearing through the reinforcing material, others failed at the scarf joint to the reinforcing material, other nipples pulled out from the bottle attachment.

Figure 3B:
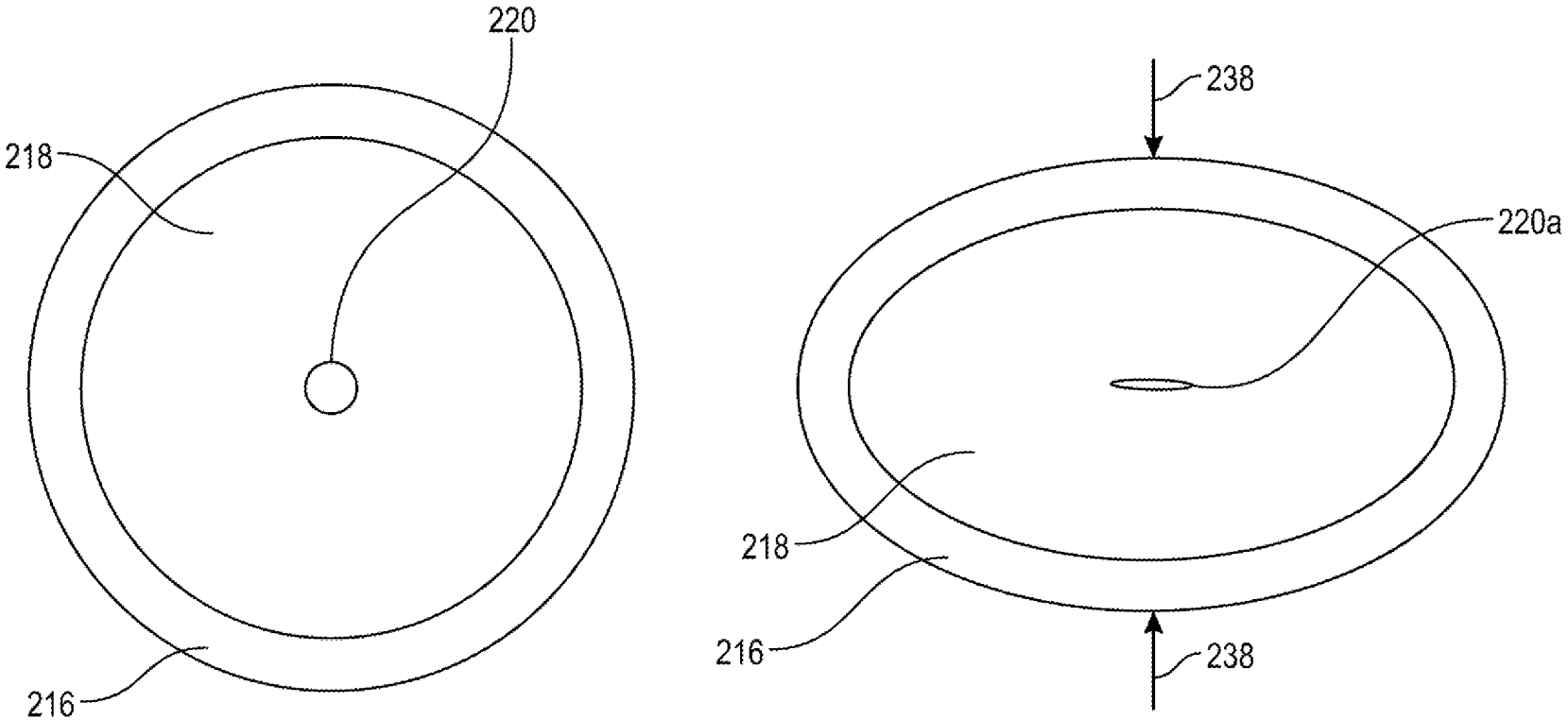
FIG. 3B illustrates compression shut-off for the infant suckling device of FIG. 1A.

Nipple compression—As shown in FIG. 3B, to enable compression shutoff, the nipple 210 must be solid so transverse compressive forces exerted on the exterior surface (as represented by arrows 238) will be transmitted through the solid, tubular reinforcing element 216 to the solid interior core portion 218, thereby compressing the central axial duct(s) (220 changing to 220*a* when compressed) and thereby shutting off fluid flow so the infant can swallow without flooding and possibly gagging from unwanted fluid flow.

Transverse compressive loading test results—Samples in the Table of FIG. 4 all have reinforcing elements at the exterior surface of the nipple portion in accordance with the design of the present invention and as illustrated in FIG. 3A. All samples shut off at similar compressive loads, generally, between about 3 and 6 PSI.

Figure 1A:
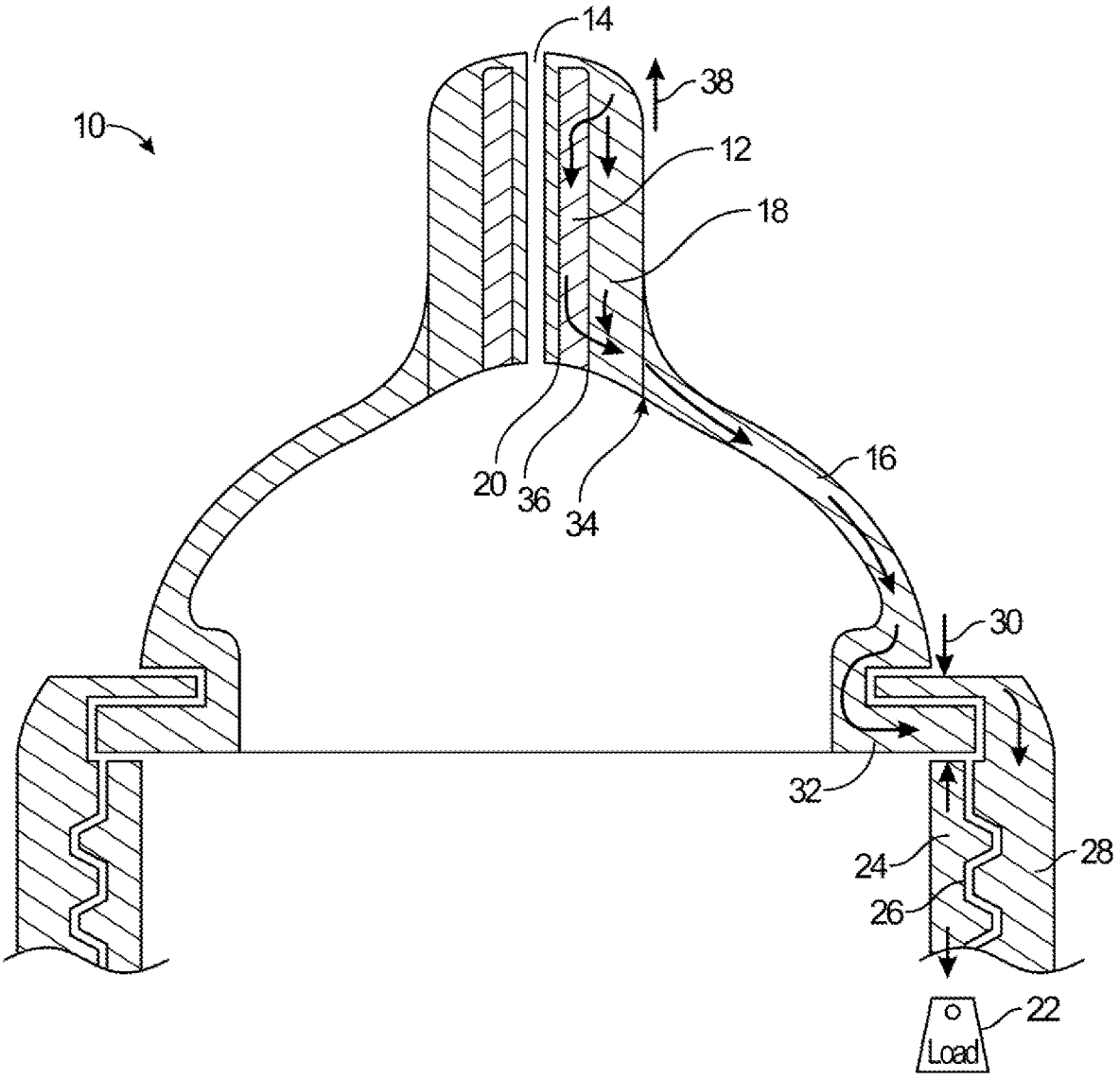
FIG. 1A (PRIOR ART)
FIG. 1A illustrates a cross-sectional view of a feeding nipple representative of prior art configurations.
Figure 2:
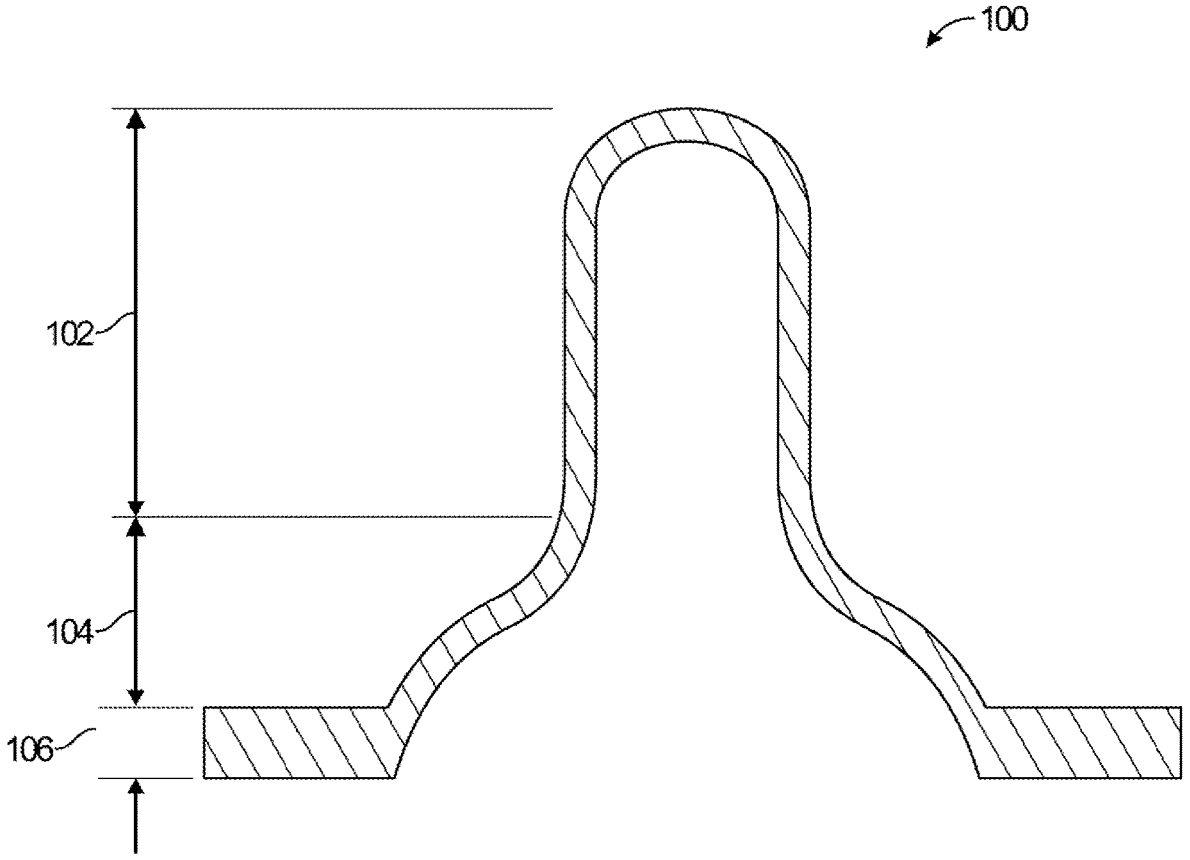
FIG. 2 (PRIOR ART)
FIG. 2 illustrates a cross-sectional view of a pacifier representative of prior art configurations.

Radial compressive loading test results, reinforcing element location—The Table of FIG. 5 provides data for samples constructed with a first reinforcing element 216 made of a Shore A50 elastomer and an interior core portion 218 made of a Shore A5 elastomer, and each having similar load-carrying capability. One sample has the reinforcing element "outside"—i.e., on the exterior nipple surface according to embodiments of the present invention and as illustrated in FIG. 3A. The other sample positions a reinforcing element on the "inside" in accordance with the prior art design illustrated in FIG. 1A and as specified by U.S. Pat. No. 8,448,796 to Silver.

Radial compressive loading test conclusions are that:

- Location of the reinforcing element critically effects required shutoff pressure.
- A reinforcing element on the outer surface is more compliant than one having almost the same cross-sectional area but which tightly surrounds the central duct(s) (as specified by Silver). As a result, the prior art element effectively has a wall thickness more than twice as thick as the reinforcing element of the present invention. The decreased compliance of a reinforcing element that tightly surrounds the central duct(s)—as in the prior art design—also increases required shutoff pressure to 16 PSI, 4 times that for reinforcing elements according to embodiments of the present invention.
- A suckling infant can generate a maximum suction of about 200 mm Hg, about 4 PSI. (See D T Geddes et. al., *Tongue movement and intra-oral vacuum in breastfeeding infants, Early Hum Dev*, July 2008; 84(7):471-477). Assuming an infant's tongue is capable of (upward) compressive pressures no more than 50% higher than its documented (downward) suction pressure suggests that infants can only shut off nipples requiring less than about 6 PSI shutoff pressure.
- All samples with reinforcing elements located on the outside surface shut off between 3 and 6 PSI, within the pressure range of what an infant can exert.
- Samples with thick-walled reinforcing elements located on the inside, closely surrounding the central duct(s), per Silver, require a shutoff pressure of 16 PSI, well beyond the estimated tongue pressure capabilities of an infant. Therefore, shutoff of a nipple constructed according to the Silver prior art nipple design by an infant is highly unlikely.

Nipple Improvements—An important advantage of embodiments of the present invention, in comparison to Silver and other prior art nipples, is a better radial compressibility. Comparing the designs of FIGS. 1B and 3B, in view of the data presented in FIG. 5, it is apparent that for reinforcing elements having the same load carrying capability, a thin-walled (e.g., 0.037-inch) tubular reinforcing element near the exterior surface of the nipple portion is radially more compliant having compression shutoff of the central duct(s) at 4 PSI. In contrast, a thick-walled (e.g., 0.088-inch) tubular reinforcing element that tightly surrounds the central duct(s), as specified by Silver, requires 4 times the compressive pressure to shutoff the duct(s). Moreover, the required compressive pressure exceeds the tongue strength of an infant.

The transverse compressibility improvements of the present invention can be visualized as a design balance. In engineering terms, the nipple must be axially strong enough to resist load-to-failure after biting damage. If the nipple utilizes small cross sections of high tear strength elastomer, the nipple will be less stretchy (i.e., lower elongation % at 15 PSI) than one having the same load-to-failure but having a larger cross section of lower tear strength elastomer. Compressibility and shutoff, on the other hand, occur radially. For nipples constructed of the same two materials and having about the same axial load-to-failure, the location of that reinforcing element is critical for compressibility. When the reinforcing element is a thin-walled tube at or near the exterior surface of the nipple, it will be quite radially compressible, as shown in FIG. 3B, and further represented in the shutoff data of the Tables in FIGS. 4 and 5. In contrast, when the reinforcing material tightly surrounds the central nipple duct(s), it must have a thick wall to provide the cross-sectional area needed for axial strength. Such a thick-walled tube, tightly surrounding the central nipple duct(s) resists radial compression requiring a higher radial load before the central duct shuts off. This latter situation is shown in FIG. 1B.

Further nipple improvements—In use, the single scarf joint (shown as reference numeral 224 in FIG. 3A) is often in shear caused by the downward pull of the nipple dome of the base portion 214 and the upward pull of the first reinforcing element 216. To decrease loading on this scarf joint 224 and thereby to decrease the chance of rupture at that location, an alternative embodiment of the present invention involves wrapping the high tear strength material of the nipple dome portion 214 around the distal end of the reinforcing element 216 to partially overlap and bond to the distal inside surface of the first reinforcing element 216. This second scarf joint 225, as illustrated in FIG. 6, is designed to relieve the load on the original single scarf joint 224.

As further illustrated in the alternate embodiment of FIG. 6, an improvement may also result from the proximal end of the first reinforcing element 216 being wrapped at least partially around the nipple tip, such as represented by reference numeral 217. Because the tear strength, and thus bite-resistance, of the material from which the first reinforcing element 216 is constructed is higher than the soft, low tear strength, material from which the nipple interior core portion 218 and nipple tip as an extension of that core portion are constructed, this design improves bite-resistance of the nipple tip.

Another alternate embodiment eliminates the bond between the reinforcing element 216 and the interior core portion 218 (as represented by reference numeral 221 in FIG. 3A) by making the reinforcing element 216 and the interior core portion 218 out of the same material. This situation is shown in the Table of FIG. 4 for solid Shore A10 and solid Shore A5 nipples. In such embodiments, the first reinforcing element 216 and the nipple interior core portion 217 will be separate in name only.

Figure 7:
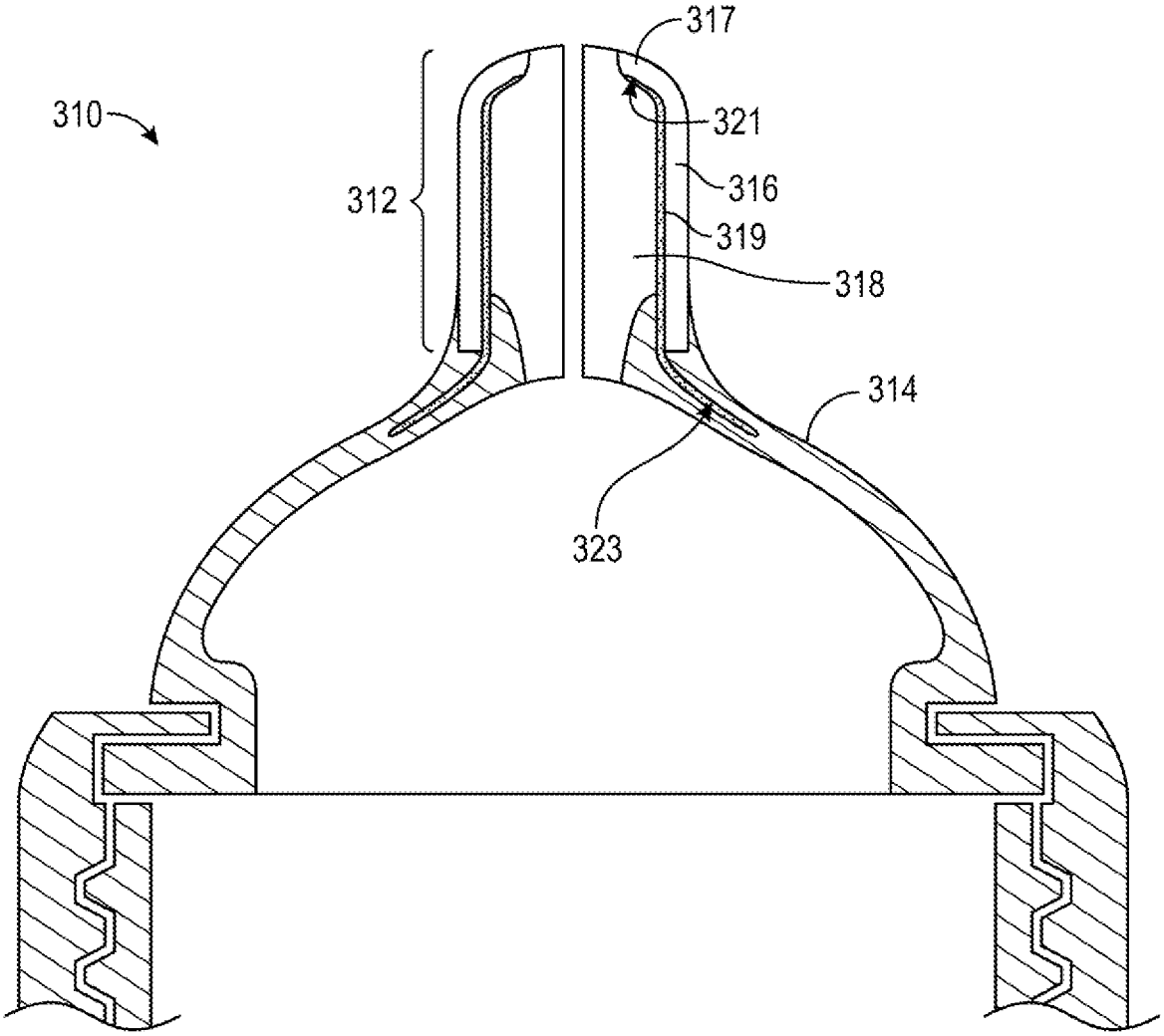
FIG. 7 illustrates a cross-sectional view of another alternative embodiment of a nutritive suckling device in accordance with the present invention.

Another alternate embodiment is illustrated in FIG. 7, which illustrates a feeding nipple generally designated as reference numeral 310. Similar components to those shown and described with reference to FIGS. 3A and 3*b* share similar designations for ease of reference. As shown, the nipple 310 comprises a nipple portion 312 attached to a dome-shaped base portion 314. In addition to the first reinforcing element 316 being constructed of a single homogeneous material in the manner and with the benefits discussed above, the nipple portion 312 also contains a second reinforcing element, generally designated by reference numeral 319. Preferably, the second reinforcing element 319 comprises a very strong, very high tear strength material. The second reinforcing element 319 is generally disposed within the nipple portion 312, longitudinally extending between the distal end of the nipple portion 312 and the proximal end of the nipple portion 312 and being located radially within at least a portion of the first reinforcing element 316. As illustrated in FIG. 7, the second reinforcing element 319 is located along the inside surface of reinforcing element 316, essentially sandwiched between the first reinforcing element 316 and the interior core portion 318, although other radial locations within the first reinforcing element 316 are possible without departing from the principles and spirit of the present invention. For example, the second reinforcing element 319 can be embedded within the first reinforcing element 316, such as, in the form of a fiber mesh tube consisting of fibers that extend between the proximal end of the nipple portion 312 and the distal end of the nipple portion 312 to provide bite-resistance to the nipple 310 without exerting tension or compression to the nipple portion 312, or as a moldable nylon or silicone material molded into the nipple portion 312 in one of a solid tubular shape, or a mesh pattern. Still further, the second reinforcing element 319 may also extend across the nipple tip 321 and/or even extend 323 into the base portion 314 for added strength.

As noted, this very strong, very high tear strength second reinforcing element 319 may be a fiber mesh of a strong polymer fiber such as polyester or nylon, such as shown and described in U.S. Pat. No. 9,913,780, incorporated herein by reference. It may also be a molded-in material, a solid tubular shape, a mesh pattern or other form to the purpose, made of a moldable material such as nylon, silicone or similar.

The very strong, very high tear strength material of the second reinforcing element 319 is designed to allow easy radial compression while providing bite resistance. Axial strengthening occurs by limiting excessive elongation which might otherwise lead to failure. Close to failure conditions, the second reinforcing element 319 carries virtually all the axial load, and so transferring load from the base portion 314 to the second reinforcing element 319 is critically important. In the alternate embodiment shown in FIG. 7, to improve load transfer, the fibers comprising the second reinforcing element 319 preferably extend into the dome-shaped region of the base portion 314, such as at 323, where the fibers can bond directly to the high tear strength material (e.g., Shore A50-A70 silicone rubber) constituting the domed region of the base portion 314.

In a further embodiment of the present invention, when the fibers of the fiber mesh tube forming a reinforcing element in the nipple portion of a feeding nipple are arranged in a very specific geometry and operate within the assumed elongation range (i.e., up to an elongation of X), they will not resist elongation of the nipple portion. Outside that range, the fibers will increasingly exert tension on the nipple portion decreasing the desirable soft, highly elastic properties of the nipple portion but strengthening the nipple portion against failure by excessive elongation. That special geometry has a pitch $P_r$ that is defined as $P_r=\pi D_r \sqrt{((1-1/X)/((X^2-1))}$ in which $P_r$ is the axial length required for one complete fiber wrap when the fiber tube is relaxed, not extended, $D_r$ is the relaxed diameter of the fiber mesh tube, and the assumed elongation ratio (X) is the length ratio of the elongated fiber mesh tube to the relaxed fiber mesh tube.

Figure 8:
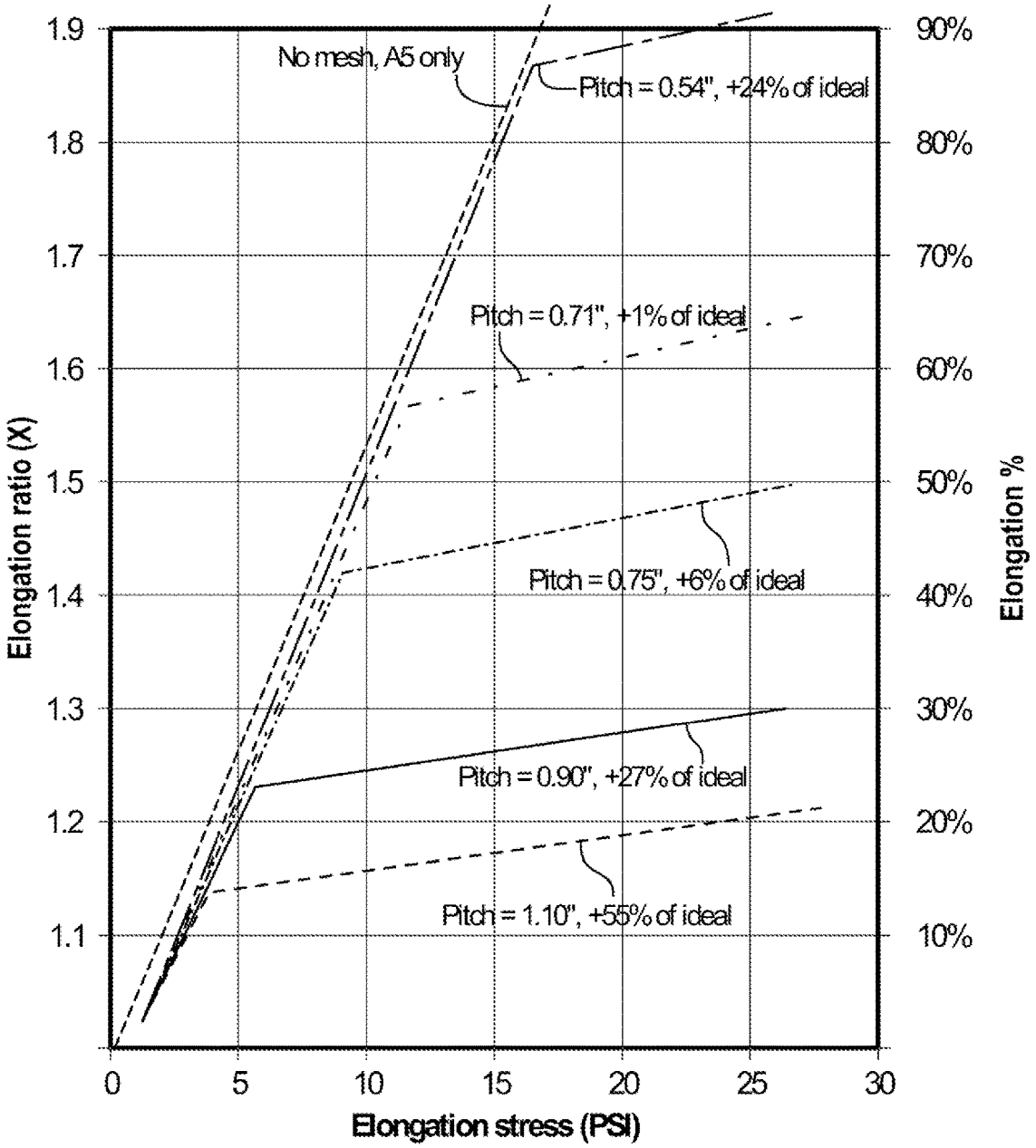
FIG. 8 illustrates the measured elongation ratio (X=the length ratio of the elongated fiber mesh tube to the relaxed fiber mesh tube) versus applied stress for 0.5-inch cylindrical A5 silicone samples with reinforcing elements in accordance with the present invention comprising fiber mesh tubes having a 0.375-inch inside diameter and different fiber pitches.
Figure 9:
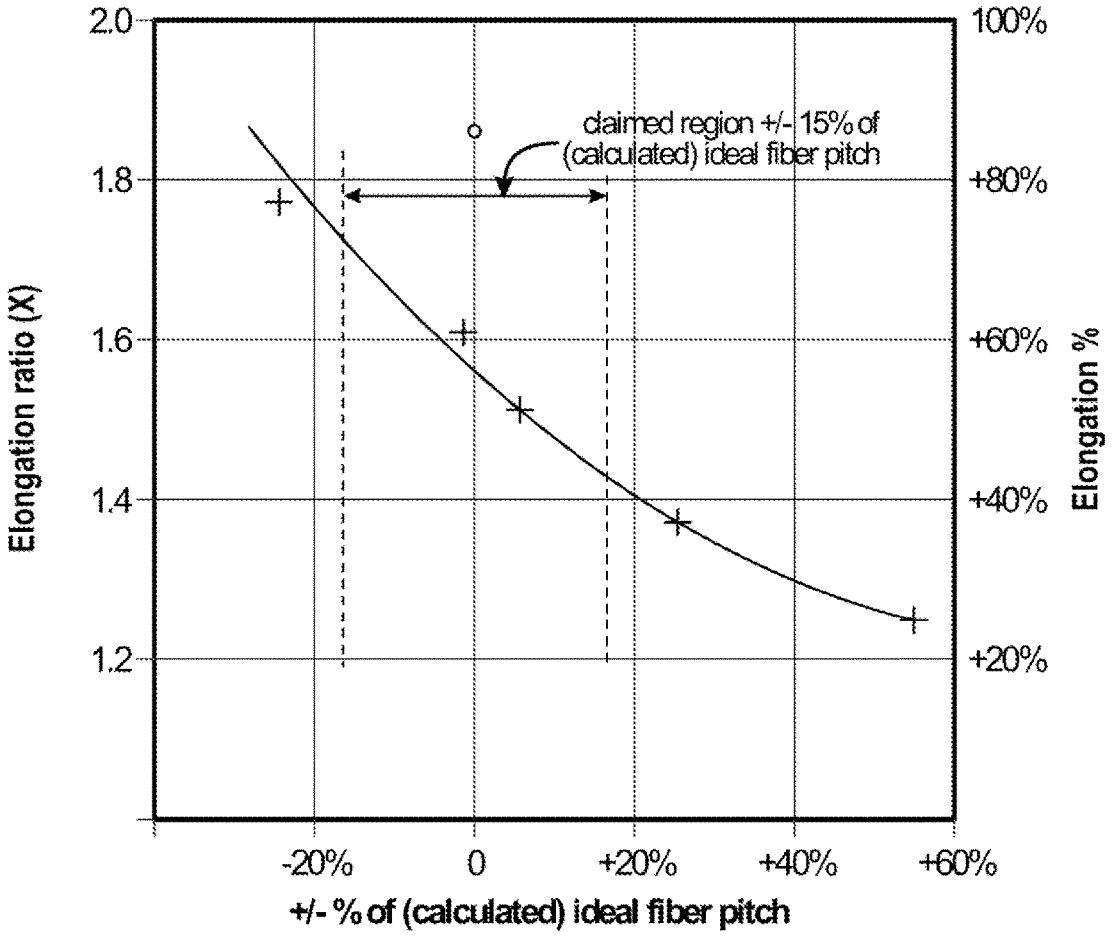
FIG. 9 illustrates the measured elongation ratio (X, a measure of "stretchiness") at 15 PSI versus the ratio of the sample fiber pitch value divided by 0.71-inch, the ideal pitch for $D_{\gamma}$=0.375 and an assumed value of X (=1.5).

FIG. 8 plots measured elongation ratio (X) versus applied stress for 0.5-inch cylindrical Shore A5 silicone samples with imbedded fiber mesh tubes having a 0.375-inch inside diameter and different fiber pitches. At a relaxed diameter ($D_r$) of the fiber mesh tube=0.375-inch and at an elongation ratio of X=1.5 the ideal pitch, calculated by the formula above, is 0.71-inch. As fiber pitch deviates from this ideal pitch, "stretchiness" of the sample at any given stress (e.g., 15 PSI) decreases. This decrease is shown in FIG. 9 which plots the elongation ratio (a measure of "stretchiness") at 15 PSI (a value chosen simply to compare samples) versus the ratio of the sample fiber pitch value divided by 0.71-inch, the ideal pitch for $D_r$=0.375 and X=1.5. The data shown in the Table of FIG. 10 reveals that the ideal pitch+/−15% covers the elongation ratio (X) range from 1.7 to 1.35 (elongation % of 70% down to 35%). For pitches larger than ideal plus 15% the fiber begins to severely impede elongation. For this reason, ideal pitch+/−15% Is claimed in this submission. This is the same+/−15% pitch range already granted in Applicant's issued U.S. Pat. No. 9,913,780, entitled "Bite-Safe Artificial Teat, which is incorporated herein by reference in its entirety.

Figure 11:
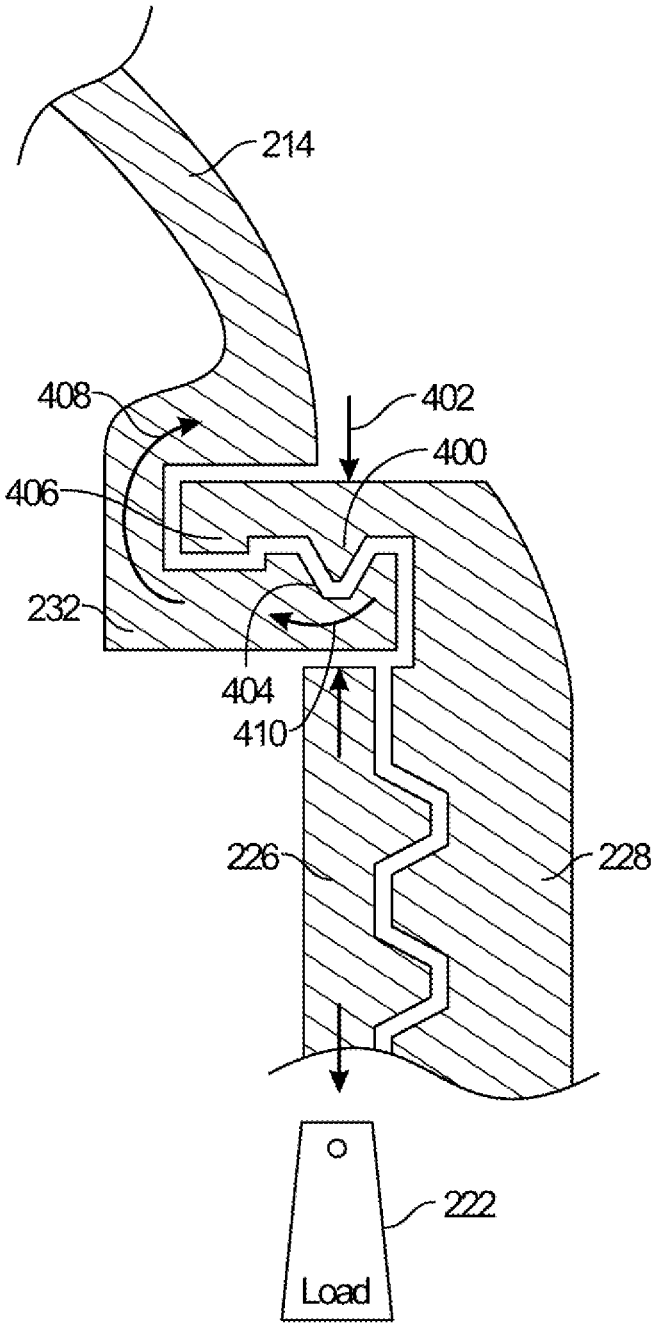
FIG. 11 illustrates a partial cross-sectional view of an embodiment for attaching an infant suckling device, such as an artificial feeding teat, to a collection container to address nipple pull-out during loading.

Nipple attachment improvements—Another failure mode under heavy loading experienced by feeding nipples is caused by pullout of the flat nipple base flange (reference numeral 232 in FIG. 3A), where the flange 232 is clamped (with clamping force shown at 234 in FIG. 3A) between the flat underside of the attachment collar 228 and the top rim of the bottle 226. The embodiment of a nipple in accordance with the present invention and as illustrated in FIG. 11 addresses this problem.

A feature found on some commercial baby bottle attachment collars is a "V-shaped" protrusion 400 describing a circular rim on the underside of the attachment collar 228 and radially positioned over the center of the top rim of the bottle 226. This "V-shaped" protrusion 400 concentrates a clamping force 402 and thereby increases resistance to pullout of the nipple 210 from the attachment collar 228 under high axial loading. However, testing shows this feature in prior art designs is insufficient to adequately prevent pullout. To further increase resistance to pullout, an improvement is provided in the present invention in the form of a "V-shaped" groove 404 on the top surface of the nipple base flange 232 that the "V-shaped" protrusion 400 on the attachment collar 228 fits into, significantly increasing resistance to pullout. Finally, a knob 406 is added to the attachment collar 228 at the position shown in FIG. 11. The purpose of this knob 530 is to hold the nipple base flange 232 flat so forces exerted on the "V-shaped" protrusion 400 and the "V-shaped" groove 404 are maintained in the radial direction. Without this knob 406, under load, the nipple tends to rotate, as represented by arrow 408, and this rotational motion might cause the nipple base flange 232 to rotate out from under the "V-shaped" protrusion 400, as represented by arrow 410.

Figure 12:
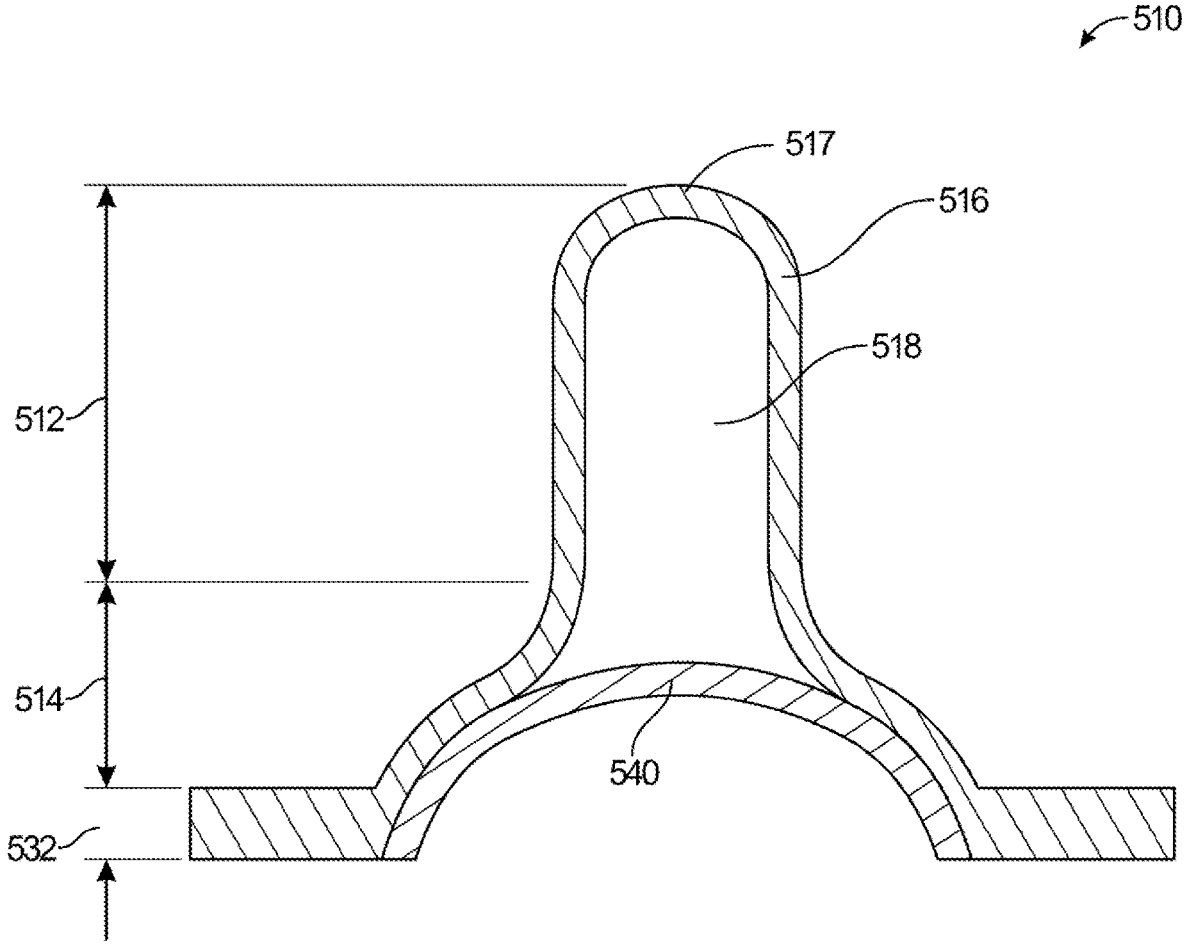
FIG. 12 illustrates a cross-sectional view of a first embodiment of a non-nutritive infant suckling device in accordance with the present invention.

The present invention is also directed to non-nutritive suckling devices, such as pacifiers. According to embodiments of the present invention, FIG. 12 shows a non-nutritive pacifier device generally designated as reference numeral 510 comprising a nipple portion 512 and a base portion 514. In preferred embodiments, the suckling device comprises a solid nipple portion 512 having a proximal end, a distal end and an exterior generally cylindrical surface although other shapes are possible without departing from the principles and spirit of the present invention. As illustrated, the nipple portion 512 includes a first reinforcing element 516 and an interior core portion 518. The first reinforcing element 516, illustrated as tubular, is positioned close to, or at the exterior surface of, the nipple portion 512. In general, the first reinforcing element 516 extends longitudinally between the distal end of the nipple portion 512 and the proximal end of the nipple portion 512 and further extends axially inward from the exterior cylindrical surface of the nipple portion 512. As illustrated, the first reinforcing element 516 can also extend to the tip of the nipple portion 512 and may extend into the base portion 514.

The nipple portion 512 further comprises an interior core portion 518 extending at least part-way between the proximal and distal ends of the nipple portion 512 and being axially surrounded by the first reinforcing element 516. The device 510 also comprises a base portion 514 attached at the distal end of the nipple portion 512. A distal end sealing membrane 540 encapsulates the interior core portion 518.

In accordance with preferred embodiments, the pacifier device 510 is bite-resistant yet retains deformability both longitudinally and transversely, and is capable of changing shape under the action of infant suckling such that the device conforms to the shape of the infant's oral cavity during suckling action. The structure of the pacifier device 510 can still be used as an axially strong artificial teat having compression shutoff by forming at least one duct (not shown) through the nipple portion 512 of the device 510.

Pacifier regulatory testing—The U.S. Code of Federal Regulations, in Title 16, Part 1511, Requirements for Pacifiers specifies that:

The pacifier guard or shield at the base of the nipple must not pull off under a 2-pound load held for 10 seconds; and The pacifier must not come apart when holding the handle or guard and gradually pulling on the nipple in all possible directions under 10-pounds for 10 seconds.

Both test requirements are far less demanding than nipple regulatory test EN 14350-1, 6.3, discussed above, which was used for pacifier mechanical testing in regards to the present invention.

Pacifier embodiments—Pacifiers covered in the present submission are intended to replicate a human nipple in non-nutritive suckling. Consequently, the ideal pacifier will have properties and action like the human nipple in non-nutritive suckling. And so, many of the properties of the artificial teat discussed in foregoing nutritive suckling sections above apply to preferred embodiments of a non-nutritive pacifier device even though with a pacifier, no fluid is transferred, just as in non-nutritive suckling with the human nipple.

Accordingly, an ideal pacifier should mimic properties of the human nipple. Specifically, it should be:

1. Strong and sufficiently bite-resistant to guard against biting damage and stretching-to-failure by an infant, even infants with teeth, and thereby to avoid broken pieces and a choking hazard.
2. Solid and deformable, so forces applied to the outside surface by the infant's tongue will be transmitted to and reshape the nipple portion, so it better conforms to the shape of the infant's oral cavity.
3. Soft, to simulate a human nipple.
4. Stretchy, so the infant can elongate it for proper positioning at the back of the mouth.

FIG. 12 illustrates the cross-section of the pacifier device 510, in accordance with embodiments of the present invention, and exhibiting the properties for an ideal pacifier. As shown, the pacifier 510 includes the first reinforcing element 516, illustrated as tubular, although other shapes are possible without departing from the principles and spirit of the present invention, constructed of material with a hardness between about Shore A5 and Shore A70 and positioned close to or at the exterior surface of the nipple portion 512. The first reinforcing element 516 has properties and cross-sectional area sufficient to protect the device against biting damage and excessive elongation by infant users while not compromising needed longitudinal and transverse deformability.

The interior core portion 518, extending mostly from the distal to proximal ends of the nipple portion 512 is protected on its sides and wrapped around its proximal tip 517 by the first reinforcing element 516 and is encapsulated on the distal end of the nipple portion 512 with a layer 540 of material like that used to construct the first reinforcing element 516. The interior core portion 518 of the nipple portion 512 is a deformable material, for example, a soft, sold low-durometer elastomer or a gel having a hardness between Shore A20 to A5 on the Shore 00 scale. Alternatively, the interior core portion 518 may be a viscoelastic material having time-dependent hardness between Shore A20 to A5 on the Shore 00 scale. In all cases, the interior core portion 518 must be capable of changing shape under action of infant suckling, such that the nipple portion 512 of the pacifier 510 conforms to the shape of the infant's oral cavity.

The dome-shaped portion of the base portion 514, and a base flange portion 532 of the pacifier device 510 are both typically constructed of tear-resistant, high-durometer material, for example Shore A30-A70 silicone rubber that is typically used to construct conventional pacifiers. In accordance with embodiments of the present invention, either of the base portion 514 or the base flange 532 may have a handle or guard of hard plastic molded onto it.

Figure 13:
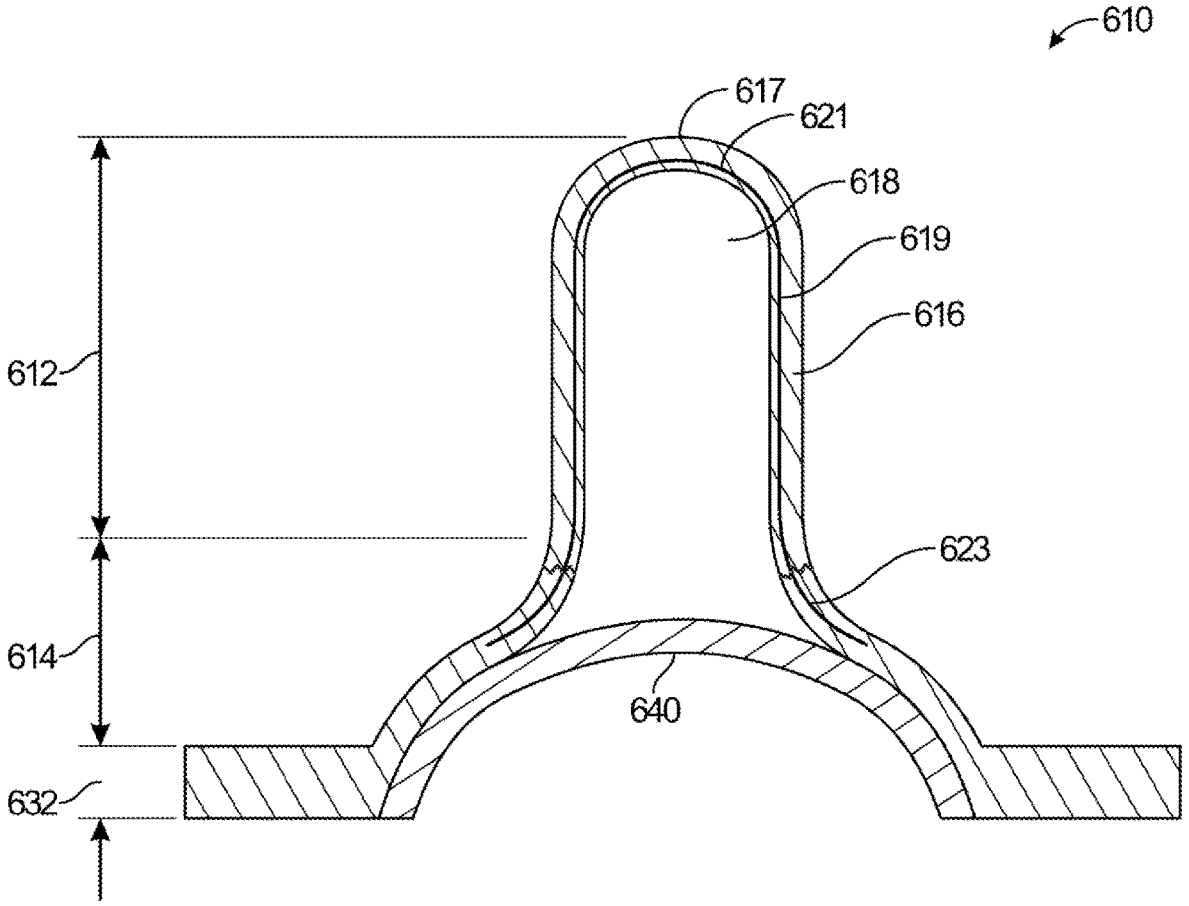
FIG. 13 illustrates a cross-sectional view of an alternate embodiment of a non-nutritive infant suckling device in accordance with the present invention.

A further embodiment of the present invention is shown in FIG. 13, which illustrates a non-nutritive pacifier device generally designated as reference numeral 610. Similar components to those shown and described with reference to FIG. 12 share similar designations for ease of reference. As shown, the pacifier 610 comprises a nipple portion 612 attached to a dome-shaped base portion 614. In addition to the first reinforcing element 616 being constructed of a single homogeneous material as described above in the embodiment of FIG. 12, the pacifier device 610 also contains a second reinforcing element 619 operating and constructed in similar fashion to the second reinforcing element described above in connection with embodiments of nutritive feeding nipples. A distal end sealing membrane 640 encapsulates the interior core portion 618. Additionally, the sealing membrane 640 may contain chopped fibers of the same material as the second reinforcing membrane 619.

Figure 14:
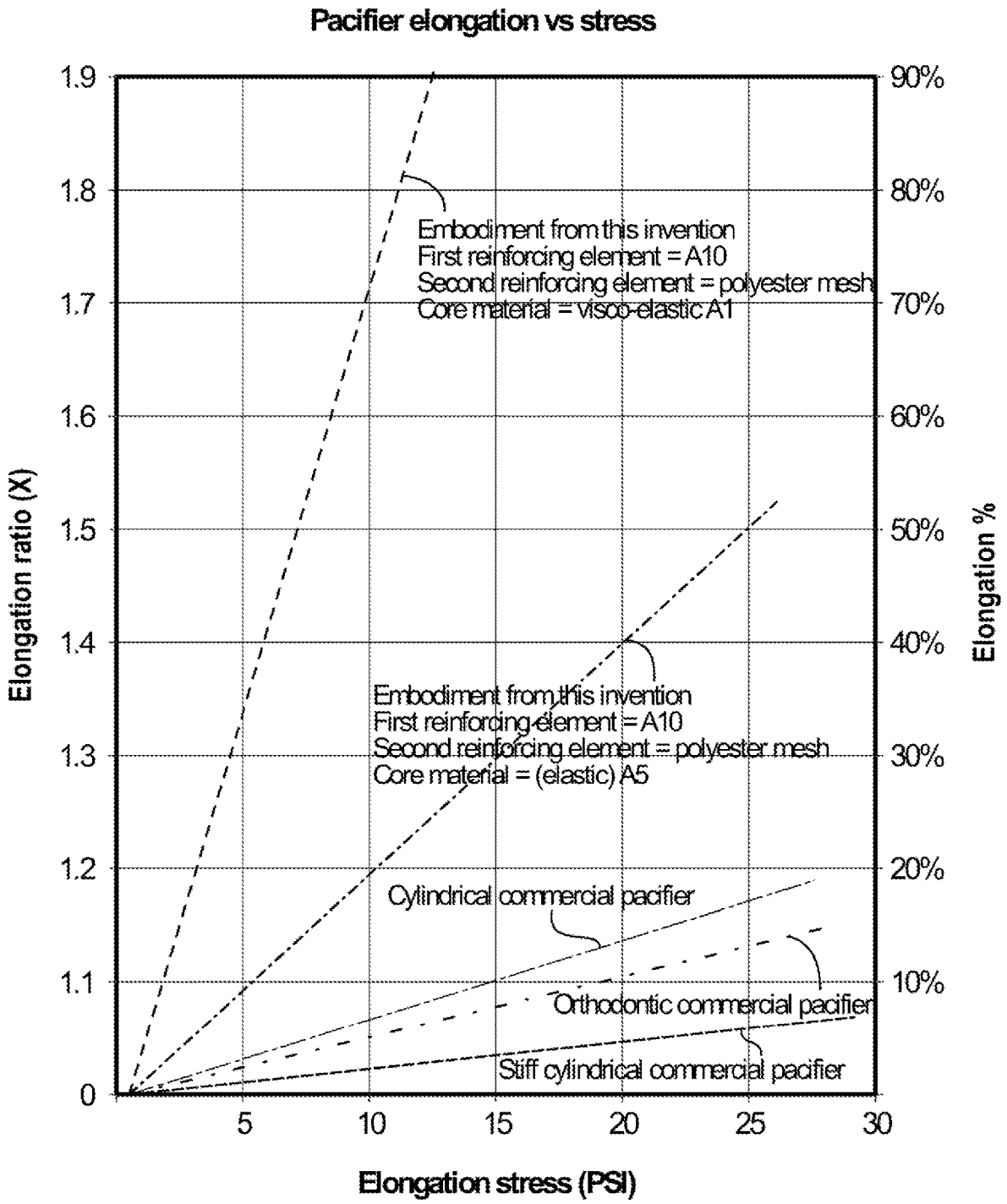
FIG. 14 illustrates pacifier elongation versus stress data for the embodiments of infant suckling devices illustrated in FIGS. 12 and 13 and of commercial pacifier devices.

FIG. 14 plots elongation of five pacifiers versus elongation stress. The bottom three pacifiers in the Table represent commercial pacifiers. Two of these are cylindrical designs having a very small dome differing only in stiffness. At 15 PSI elongation stress, the stiffer one elongates only 3%, while the less stiff one elongates 10%. The orthodontic commercial pacifier elongates only 7% at 15 PSI. All three commercial pacifier designs are very stiff and quite poor in elongation.

The top two curves in FIG. 14 represent pacifier embodiments in accordance with the present invention. Both have a Shore A10 first reinforcing element and a second reinforcing element of polyester fiber mesh. One sample has a nipple core of elastic Shore A5 silicone. That sample elongated 30% at 15 PSI, more than 3 times that of the commercial pacifiers tested. The second sample has a nipple core of viscoelastic Shore A1 silicone. That sample elongated more than 100% at 15 PSI, more than 10 times the commercial pacifiers tested. Having 3 to 10 times higher elongation deformability, pacifiers according to the present invention are expected to reshape and conform to the shape of the infant's oral cavity far better than can typical commercial pacifiers. This superior deformability will address the published detriments of typical commercial pacifiers.

When elongated and released, the four elastic pacifiers relaxed back to their starting shape in a small fraction of a second. When elongated and released the viscoelastic pacifier slowly relaxed back to its starting shape over about 4 seconds. All five pacifiers tested for FIG. 14 carried 30 pounds without failure when tested by the procedure of EN 14350-1, 6.3.

The foregoing description of embodiments of the present invention has been presented for the purposes of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular uses contemplated.

What is claimed is:

1. A device for nutritive infant suckling which is bite-resistant yet retains longitudinal deformability, transverse deformability, and radial compressibility comprising:

a solid nipple portion having a proximal end, a distal end and an exterior generally cylindrical surface, said nipple portion further having at least one duct extending generally longitudinally from the distal end of said nipple portion to the proximal end of said nipple portion;

wherein at least a portion of the nipple portion comprises a first reinforcing element extending longitudinally between the distal end of the nipple portion and the proximal end of the nipple portion and extending radially inward from the exterior cylindrical surface of the nipple portion, said first reinforcing element having a hardness of about Shore A5 to about Shore A70 and having properties and a cross-sectional area sufficient to impart bite-resistance and axial strength for expected biting damage and excessive elongation by an infant user without compromising longitudinal deformability, transverse deformability, and radial compressibility;

said nipple portion further comprising an interior core portion extending at least part-way between the proximal and distal ends of the nipple portion and being axially surrounded by the first reinforcing element and defining the at least one duct, said interior core portion comprising an elastomer having a hardness of about Shore A1 to about Shore A20; and a base portion attached at the distal end of the nipple portion and having an open interior volume contiguous with the distal end of the at least one duct, wherein said device results in a composite nipple portion having sufficient radial compressibility to allow a compressive force applied transversely by an infant's tongue of 8 PSI or less to be transmitted through the nipple portion causing a compressive collapse of the at least one duct and thereby stopping fluid flow.

2. The infant suckling device of claim 1 which can carry a 20-pound axial load for 10 seconds after having been punctured across its diameter with a punch of at least 2 mm diameter and the resulting composite nipple portion having sufficient radial compliance to shut off fluid flow under a radial compressive pressure less than 8 PSI.

3. The infant suckling device of claim 1 which can pass nipple regulatory test EN 14350 and the resulting composite nipple portion having sufficient radial compliance to shut off fluid flow under a compressive pressure less than 8 PSI.

4. The infant suckling device of claim 1, wherein the first reinforcing element and the interior core portion are constructed of the same material and there is no geometric delineation separating said first reinforcing element from said interior core portion, and wherein the first reinforcing element and the interior core portion have the same hardness within the range of about Shore A5 to about Shore A20.

5. The infant suckling device of claim 1, wherein the first reinforcing element and the interior core portion of the nipple portion each comprise a material selected from the group consisting of silicone rubber, thermoplastic elastomer (TPE), and latex.

6. The infant suckling device of claim 1, further comprising a second reinforcing element disposed within the nipple portion, longitudinally extending between the distal end of the nipple portion and the proximal end of the nipple portion and being located radially within at least a portion of the first reinforcing element;

wherein the first reinforcing element and the second reinforcing element each have properties and cross-sectional areas sufficient to impart needed bite-resistance and adequate axial strength to protect against biting damage and excessive elongation by infant users and wherein the resulting infant suckling device maintains radial deformability allowing a compressive force of 8 PSI or less applied transversely by an infant's tongue to be transmitted through the nipple portion to cause a compressive collapse of the at least one duct and thereby stopping fluid flow.

7. The infant suckling device of claim 1, wherein the base portion has a hardness of about Shore A30 to about Shore A70.

8. The infant suckling device of claim 1, wherein an axial load applied from the base portion to the distal end of the nipple portion is transferred via the first reinforcing element through two scarf joints disposed on inside and outside distal ends of the reinforcing element.

9. A device for nutritive infant suckling which is bite-resistant yet retains longitudinal deformability, transverse deformability, and radial compressibility comprising:

a solid nipple portion having a proximal end, a distal end and an exterior generally cylindrical surface, said nipple portion further having at least one duct extending generally longitudinally from the distal end of said nipple portion to the proximal end of said nipple portion;

wherein at least a portion of the nipple portion comprises a first reinforcing element extending longitudinally between the distal end of the nipple portion and the proximal end of the nipple portion and extending axially radially inward from the exterior cylindrical surface of the nipple portion;

said first reinforcing element having a hardness of about Shore A5 to about Shore A70;

a second reinforcing element disposed within the nipple portion, longitudinally extending at least between the distal end of the nipple portion and the proximal end of the nipple portion and being located radially within at least a portion of the first reinforcing element;

said nipple portion further comprising an interior core portion extending at least part-way between the proximal and distal ends of the nipple portion and being axially surrounded by the first reinforcing element and defining the at least one duct, said interior core portion comprising an elastomer having a hardness of about Shore A1 to about Shore A20; and a base portion attached at the distal end of the nipple portion and having an open interior volume contiguous with the distal end of the at least one duct, wherein the first reinforcing element and the second reinforcing element each have properties and cross-sectional areas sufficient to impart needed bite-resistance and adequate axial strength to protect against biting damage and excessive elongation by infant users, wherein said device results in a composite nipple portion having sufficient radial compressibility to allow a compressive force applied transversely by an infant's tongue of 8 PSI or less to be transmitted through the nipple portion causing a compressive collapse of the at least one duct and thereby stopping fluid flow, wherein the second reinforcing element disposed comprises a fiber mesh tube consisting of fibers that extend at least between the proximal end of the nipple portion and the distal end of the nipple portion to provide bite-resistance to the nipple portion without exerting tension or compression to the nipple portion up to an elongation of X and when elongation exceeds X to provide strengthening against elongation-to-failure, and wherein the fibers of the fiber mesh tube are arranged at a pitch $P_r$ that is determined according to $P_r=\pi D_r \sqrt{((1-1/X)/((X^2-1))}$ in which $P_r$ is the axial length required for one complete fiber wrap when the fiber tube is relaxed, not extended, $D_r$ is the relaxed diameter of the fiber mesh tube, and X is the length ratio of the elongated fiber mesh tube to the relaxed fiber mesh tube.

10. The infant suckling device of claim 9, wherein the fiber mesh tube is a helically wound braid at about +/−15% of the pitch $P_r$ for a specific diameter $D_r$.

11. The infant suckling device of claim 9, wherein the fibers forming the fiber mesh of the second reinforcing element comprise a polyester or nylon fiber, or a moldable nylon or silicone material molded into the nipple portion in one of a solid tubular shape, or a mesh pattern.

12. A device for non-nutritive infant suckling which is bite-resistant yet retains longitudinal deformability, transverse deformability, and radial compressibility comprising:

a solid nipple portion having a proximal end, a distal end and an exterior generally cylindrical surface;

wherein at least a portion of the nipple portion comprises a first reinforcing element extending longitudinally between the distal end of the nipple portion and the proximal end of the nipple portion and extending radially inward from the exterior cylindrical surface of the nipple portion, said first reinforcing element having a hardness of about Shore A5 to about Shore A70, a second reinforcing element disposed within the nipple portion, longitudinally extending at least between the distal end of the nipple portion and the proximal end of the nipple portion and being located radially within at least a portion of the first reinforcing element;

wherein the first reinforcing element and the second reinforcing element each have properties and a cross-sectional area sufficient to impart bite-resistance and axial strength to protect against biting damage and excessive elongation by an infant user without compromising longitudinal deformability, transverse deformability, and radial compressibility; and said nipple portion further comprising an interior core portion extending at least part-way between the proximal and distal ends of the nipple portion and being axially surrounded by the first reinforcing element, said interior core portion comprising a deformable material made from at least one of a soft elastomer, a viscoelastic material, or a gel capable of changing shape under action of infant suckling; and a base portion attached at the distal end of the nipple portion, wherein the second reinforcing element comprises a fiber mesh tube consisting of fibers that extend at least between the proximal end of the nipple portion and the distal end of the nipple portion to provide bite-resistance to the nipple portion without exerting tension or compression to the nipple portion up to an elongation of X and when elongation exceeds X to provide strengthening against elongation-to-failure, wherein the fibers of the fiber mesh tube are arranged at a pitch $P_r$ that is determined according to $P_r=\pi D_r \sqrt{((1-1/X)/((X^2-1))}$ in which $P_r$ is the axial length required for one complete fiber wrap when the fiber tube is relaxed, not extended, $D_r$ is the relaxed diameter of the fiber mesh tube, and X is the length ratio of the elongated fiber mesh tube to the relaxed fiber mesh tube.

13. The infant suckling device of claim 12, wherein said nipple portion includes at least one duct extending generally longitudinally from the distal end of said nipple portion to the proximal end of said nipple portion.

14. The infant suckling device of claim 13, wherein the nipple portion has sufficient radial deformability to allow a compressive force applied transversely by an infant's tongue of 8 PSI or less to be transmitted through the nipple portion causing a compressive collapse of the at least one duct and thereby stopping fluid flow.

15. The infant suckling device of claim 12 which can carry a 20-pound axial load for 10 seconds after having been punctured across its diameter with a punch of at least 2 mm diameter and the resulting composite nipple portion having sufficient radial compliance to shut off fluid flow under a radial compressive pressure less than 8 PSI.

16. The infant suckling device of claim 12 which can pass nipple regulatory test EN 14350 and the resulting composite nipple portion having sufficient transverse compliance to shut off fluid flow under a compressive pressure less than 8 PSI.

17. The infant suckling device of claim 12, wherein the first reinforcing element and the interior core portion are constructed of the same material and there is no geometric delineation separating said first reinforcing element from said interior core portion, and wherein the first reinforcing element and the interior core portion have the same hardness within the range of about Shore A5 to about Shore A25.

18. The infant suckling device of claim 12, wherein the interior core portion is capable of changing shape under the action of infant suckling such that the device conforms to the shape of the infant's oral cavity during suckling action.

19. The infant suckling device of claim 12, wherein the first reinforcing element and the interior core portion of the nipple portion each comprise a material selected from the group consisting of silicone rubber, thermoplastic elastomer (TPE), and latex.

20. The infant suckling device of claim 12, wherein the fiber mesh tube is a helically wound braid at about +/−15% of the pitch $P_r$ for a specific diameter $D_r$.

21. The infant suckling device of claim 12, wherein the fibers forming the fiber mesh of the second comprise a polyester or nylon fiber, or a moldable nylon or silicone material molded into the nipple portion in one of a solid tubular shape, or a mesh pattern.

22. The infant suckling device of claim 12, wherein the base portion has a hardness of about Shore A30 to about Shore A70.

* * * * *